US007978997B2

(12) United States Patent
Tokuda

(10) Patent No.: US 7,978,997 B2
(45) Date of Patent: Jul. 12, 2011

(54) DEVELOPER CARTRIDGES, PROCESS CARTRIDGES, AND IMAGE FORMATION DEVICES

(75) Inventor: Hiroshi Tokuda, Aichi-ken (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 1247 days.

(21) Appl. No.: 11/531,027

(22) Filed: Sep. 12, 2006

(65) Prior Publication Data

US 2007/0059018 A1 Mar. 15, 2007

(30) Foreign Application Priority Data

Sep. 15, 2005 (JP) ..... 2005-268926

(51) Int. Cl.
*G03G 15/00* (2006.01)

(52) U.S. Cl. ..... 399/90; 399/12; 399/119

(58) Field of Classification Search ..... 399/90, 399/12, 119
See application file for complete search history.

(56) References Cited

U.S. PATENT DOCUMENTS 6,823,160 B2 11/2004 Okabe
2004/0028424 A1* 2/2004 Yokoi ..... 399/90
2005/0063735 A1 3/2005 Okabe
2005/0135831 A1* 6/2005 Kawaguchi et al. ..... 399/90
2005/0135832 A1* 6/2005 Kubota et al. ..... 399/90

FOREIGN PATENT DOCUMENTS

JP 08-234563 9/1996
JP 11-282324 10/1999
JP 2000-356902 12/2000
JP 2002169449 6/2002
JP 2005-241949 9/2005

OTHER PUBLICATIONS

Notice of Reasons for Rejection: Dispatch Number: 599492, Mailing Date: Oct. 2, 2008, Patent Application No. 2005-268926.

* cited by examiner

*Primary Examiner* — David P Porta
*Assistant Examiner* — Bryan P Ready
(74) *Attorney, Agent, or Firm* — Banner & Witcoff, Ltd.

(57) ABSTRACT

When a developer cartridge is not attached to an image formation apparatus body frame, a developer electrode included with the cartridge is disposed at a retract position at which the developer electrode does not protrude outside the cartridge. This protects the developer electrode from damage possibly caused by interference or contact with other components. After the developer cartridge is attached to the body frame, when the developer roller is rotated, the developer electrode is displaced to a connection position at which the developer electrode protrudes outside the cartridge (and is connected to a power supply electrode provided with the body frame).

16 Claims, 17 Drawing Sheets

DEVELOPER CARTRIDGES, PROCESS CARTRIDGES, AND IMAGE FORMATION DEVICES

CROSS REFERENCE TO RELATED APPLICATION

This application claims priority from Japanese Patent Application No. 2005-268926 filed in Japan on Sep. 15, 2005. This Japanese patent application is entirely incorporated herein by reference.

TECHNICAL FIELD

This disclosure relates to developer cartridges, process cartridges, and image formation devices, e.g., that include developer cartridges and/or process cartridges as described herein.

BACKGROUND

An electrophotographic image formation device is known to have a developer cartridge that is configured to be attachable to and detachable from an image formation device mainbody (simply referred to as a device "mainbody" in this "BACKGROUND" section). The developer cartridge includes a developer roller that provides a toner supply, for image developing, to electrostatic latent images formed on a photosensitive member. As an example, FIG. 8 of Japanese Laid Open Patent Publication No. 2003-295614 (which corresponds to FIG. 8A of U.S. Pat. No. 6,823,160) shows a configuration in which a developer electrode is electrically connected to a developer roller, and the developer electrode protrudes outside of a developer cartridge. With such a configuration, when the developer cartridge is attached to the device mainbody, the developer electrode comes in contact with a power supply electrode provided at the device mainbody side so that, at the time of printing, a bias voltage is applied via these electrodes to the developer roller from a power supply provided in the device mainbody.

One potential problem with such a configuration is that when the developer cartridge is individually carried around, the developer electrode may interfere with other components and/or become damaged because the electrode protrudes outside of the developer cartridge.

SUMMARY

This summary is provided to introduce a selection of concepts in a simplified form that are further described below in the Detailed Description. This summary is not intended to identify key features or essential features of the claimed subject matter.

One aspect of the present invention relates to developer cartridge and developer electrode structures and combinations in which the developer electrode is prevented from being damaged when the developer cartridge is moved or carried around.

In accordance with at least some examples of the present invention, developer cartridges are provided that are attachable to and detachable from image formation device mainbodies. The developer cartridge may include, for example: a developer roller that supplies developer to an image carrier; and a developer electrode that is electrically connected to the developer roller. The developer electrode may be disposed at a connection position to connect to a power supply electrode provided on a side of the image formation device mainbody for bias application when the cartridge is attached to the image formation device mainbody. Furthermore, the developer electrode may be disposed at a retract position, retracted from the connection position, when the cartridge is not attached to the image formation device mainbody.

Another aspect of the present invention relates to process cartridges that include, for example: (a) a developer cartridge, e.g., of the types described above, that is attachable to and detachable from an image formation device mainbody and that have a developer electrode that is movable between a connection position and a retract position as described above; and (b) an image carrier cartridge that is attachable to and detachable from the developer cartridge. The image carrier cartridge may house an image carrier, such as a photosensitive drum. The overall process cartridge (e.g., including the developer cartridge and the image carrier cartridge) may be attachable to and detachable from the image formation device mainbody (e.g., as a single part and/or as multiple parts).

Another aspect of the present invention relates to image formation devices that include: (a) a mainbody; (b) a developer cartridge (e.g., of the types described above) that is attachable to and detachable from the mainbody (e.g., including a developer electrode that is movable between a connection position and a retract position); (c) a drive unit that applies a driving force to the developer roller; and (d) a bias application unit that is electrically connected to a power supply electrode provided with the mainbody and applies a developer bias to the developer roller through the developer electrode.

Additional example aspects of this invention relate to developer cartridges that include: a cartridge housing; a developer roller that outputs developer from the cartridge housing; a developer electrode electrically connected to the developer roller; and an old/new condition indication member that indicates whether the developer cartridge is in an old condition or a new condition. In such structures, the developer electrode may be engaged or integrally formed with the old/new condition indication member. The old/new condition indication member may indicate whether the developer cartridge is in an old or new condition based on its positioning or arrangement (e.g., the member may be movable from a "new-condition position" (e.g., before any use of the cartridge) to an "old-condition position" (e.g., once inserted into an image forming apparatus) in response to a driving force to the developer roller from an external source (e.g., a motor provided with an image forming device)). If desired, the developing electrode also may be movable between a retract position and a connection position, as described above. Additionally, in such structures, the developer roller and the old/new condition indication member may be separated by a space, and an arm member may extend through this space to electrically connect the developer roller to the developer electrode.

Still further aspects of this invention relate to process cartridges including image carrier cartridges and developer cartridges having old/new condition indication members of the types described above. Yet additional aspects of this invention relate to image formation devices that include developer cartridges having old/new condition indication members of the types described above.

BRIEF DESCRIPTION OF THE DRAWINGS

A more complete understanding of the present invention and the potential advantages thereof may be acquired by referring to the following description of illustrative embodiments in consideration of the accompanying drawings.

DETAILED DESCRIPTION

In the detailed description that follows, connections between various parts and components of overall structures are described and/or illustrated. These connections, unless otherwise specified, may be direct or indirect, and this specification is not intended to be limiting in this respect.

A. FIRST EXAMPLE

By referring to FIGS. 1 to 16, a first example of structures, features, and aspects according to the present invention will be described.

1. Entire Configuration of an Example Image Formation Device

Figure 1:
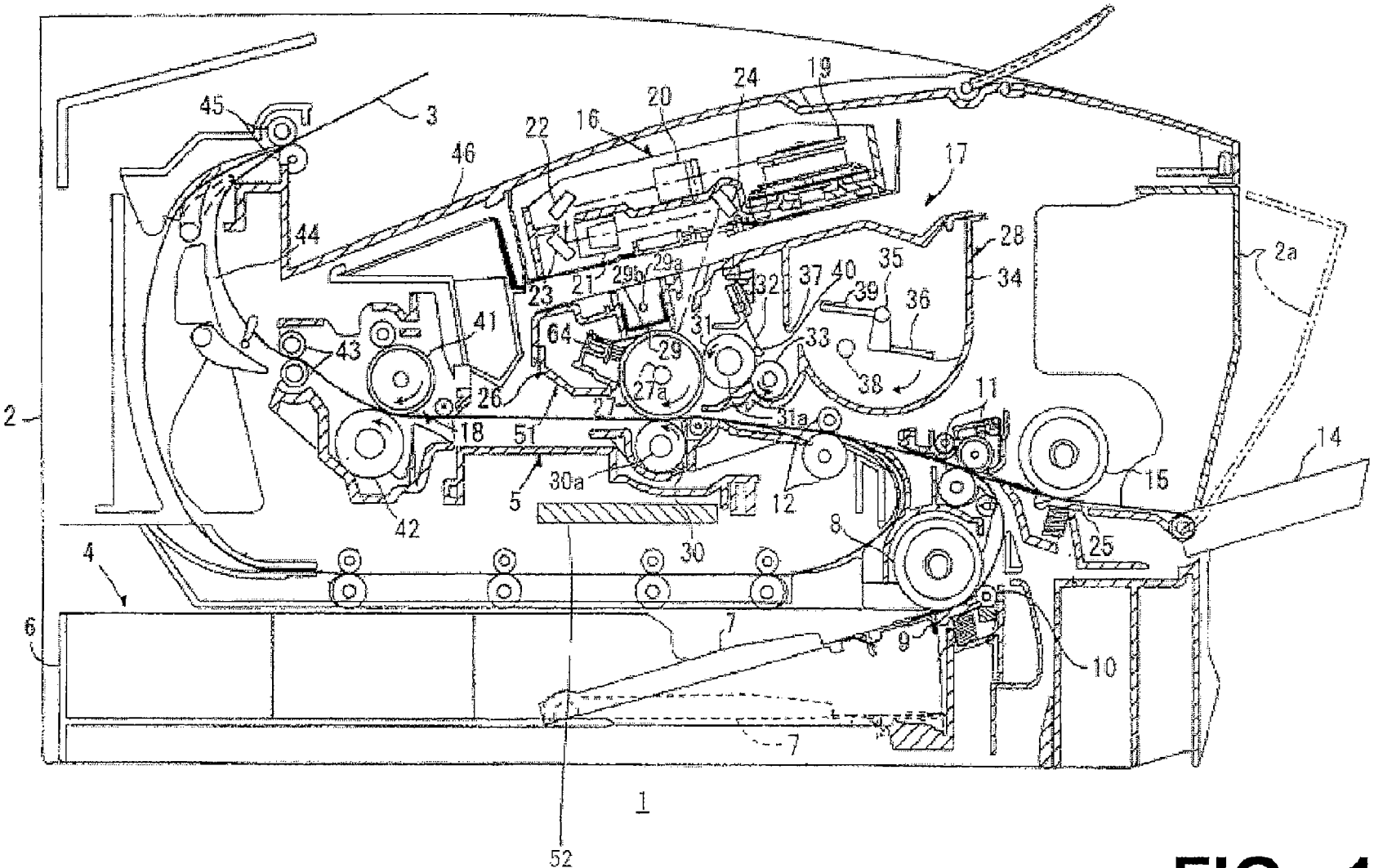
FIG. 1 is a cross sectional view of an image formation device, e.g., a laser printer, according to one example of the present invention.

FIG. 1 is a cross sectional view of a main component of an example image formation device according to the present invention. While the image formation device is a laser printer 1 in this illustrated example, those skilled in the art will understand that features and aspects of the present invention may be applied to and/or practiced in other types of devices, such as facsimile machines, copying machines, other types of printers, multi-function machines, and the like. In FIG. 1, the laser printer 1 is configured to include a feeder section 4, an image formation section 5, and others. The feeder section 4 is provided to feed paper 3 into a body frame 2, which serves as an image formation device body, and the image formation section 5 forms images on the incoming paper 3. In the description below, the right side of FIG. 1 is referred to as the "front side."

a. Feeder Section

The feeder section 4 includes, at the bottom portion of the body frame 2: a detachable paper feed tray 6; a paper pressboard 7 provided inside the paper feed tray 6; a paper feed roller 8 and a separation pad 9 provided above the front end portion of the paper feed tray 6; paper dust rollers 10 and 11 provided on the downstream side of the paper feed roller 8 in the paper conveying direction; and a resist roller 12 provided on the downstream side of the paper dust rollers 10 and 11 in the paper conveying direction.

The paper 3 positioned at the top of the paper pressboard 7 is pressed by a spring (not shown) toward the paper feed roller 8 by the paper pressboard 7. As the paper feed roller 8 rotates, the paper 3 is sandwiched between the paper feed roller 8 and the separation pad 9, from where the paper then may be fed piece-by-piece.

The paper 3 fed in this manner then is cleared of paper dust by the paper dust rollers 10 and 11, and it then is forwarded to the resist roller 12. The resist roller 12 of this example printer structure 1 is configured as a pair of rollers, and this pair of rollers forwards the paper 3 to an image formation position after a resist process.

The feed section 4 of this example printer structure 1 is configured to also include: a multi-purpose tray 14; a multi-purpose-side paper feed roller 15; and a multi-purpose-side separation pad 25. The multi-purpose-side paper feed roller 15 and the multi-purpose-side separation pad 25 are provided to feed paper 3 from the multi-purpose tray 14 to the image formation section 5. More specifically, paper 3 stacked on the multi-purpose tray 14 is sandwiched by the multi-purpose-side paper feed roller 15 and the multi-purpose-side separation pad 25 before being fed, piece-by-piece, by rotation of the multi-purpose-side paper feed roller 15.

2. Image Formation Section

The image formation section 5 of this example printer structure 1 includes: a scanner section 16; a process cartridge 17; and a fixing section 18. These sections will be described in more detail below.

a. Scanner Section

The scanner section 16 in this example printer structure 1 is provided at an inner upper portion of the body frame 2. This example scanner section 16 includes a laser light emission section (not shown), a polygon mirror 19 that is rotated and driven, lenses 20 and 21, and reflective mirrors 22, 23, and 24. As indicated by the dotted lines in FIG. 1, the laser beam passes through or is reflected by the polygon mirror 19, the lens 20, the reflective mirrors 22 and 23, the lens 21, and the reflective mirror 24 in this order. The laser beam is selectively emitted from the laser light emission section based on image data. Furthermore, the laser beam is irradiated onto the surface of a photoconductive drum 27 of the process cartridge 17 by high-speed scanning to thereby form an electrostatic latent image on the photoconductive drum 27 corresponding to the image data.

b. Process Cartridge

The process cartridge 17 is provided at a lower portion of the scanner section 16. The process cartridge 17 of this example includes a drum cartridge 26 and a developer cartridge 28. The drum cartridge 26 serves as a cartridge for the photosensitive member that is freely attached/detached to/from the body frame 2. The developer cartridge 28 is housed at least partially in or on the drum cartridge 26 and supplies developer to the drum cartridge 26. As shown in FIG. 1, the body frame 2 is provided with, on the front surface, a front cover 2*a* that can open and close by rotation about its lower end portion as a base, i.e., as a rotational axis. This front cover 2*a* is opened to enable the process cartridge 17 to be attachable to/detachable from the body frame 2.

The developer cartridge 28 of this example is housed at least partially in or on the drum cartridge 26 in a manner so as to be attachable/detachable thereto/therefrom. The developer cartridge 28 includes a developer roller 31, a film thickness restriction blade 32, a supply roller 33, and a toner accommodating section 34. The developer roller 31 serves as a carrier of developer, and the toner accommodating section 34 serves as a bulk supply hopper for the developer. The toner accommodating section 34 may be filled with a developer, e.g., a positively-charged non-magnetic single-component toner or any other suitable or desired toner or developer composition.

The toner in the toner accommodating section 34 may be stirred by an agitator 36 that is supported by a rotation shaft 35 positioned at the center of the toner accommodating section 34. After such stirring, toner is ejected from a toner supply port 37 formed toward a rear side portion of the toner carrying section 34. This agitator 36 is rotated and driven in the direction of an arrow shown in FIG. 1 (in the clockwise direction in this illustrated example) in response to power input from a main motor 66 (refer to FIG. 2). The toner accommodating section 34 of this example developer cartridge structure 28 further is provided, on its side walls (side walls in the depth direction of FIG. 1), with a window section 38 for allowing detection of a remaining amount of toner. The window sections 38 each are cleared by a corresponding wiper 39, which also may be supported by the rotation shaft 35.

The supply roller 33 is rotatably mounted at the rear position of the toner supply port 37. The developer roller 31 is rotatably mounted on the opposite side of the supply roller 33 from the supply port 37. The supply roller 33 and developer roller 31 in this example structure 28 abut each other such that both are compressed to some degree.

The supply roller 33 in this example structure is configured as a metal roller shaft covered by a roller or sleeve made from a conductive foam or rubber material. This supply roller 33 is rotated and driven in the direction of an arrow shown in FIG. 1 (counterclockwise direction) in response to power input from the main motor 66.

The developer roller 31 in this example printer structure 1 is configured as a metal roller shaft 31*a* covered by a roller or sleeve of a conductive foam or rubber material. The body frame 2 includes therein a high-voltage power supply circuit board 52 below the process cartridge 17. The high-voltage power supply circuit board 52 includes a bias application circuit 71 (refer to FIG. 2), as well as other circuits. At the time of image developing, a developer bias voltage is applied to the developer roller 31 by the bias application circuit 71. This developer roller 31 is rotated and driven in the direction of an arrow as shown in FIG. 1 (counterclockwise direction) in response to power input from the main motor 66.

The film thickness restriction blade 32 is provided in the vicinity of the developer roller 31. This example film thickness restriction blade 32 includes a press section 40 at the tip end portion of the blade body, which may be made, for example, from a metal leaf spring material. The press section 40 of this example blade structure 32 has a semicircular cross section and is made of an insulative silicone rubber. The film thickness restriction blade 32 is supported by the developer cartridge 28 in the vicinity of the developer roller 31, and the press section 40 thereof is pressed onto the developer roller 31 by the elasticity of the blade body.

After being ejected from the toner supply port 37, toner is supplied to the developer roller 31 by the rotation of the supply roller 33. At the time of toner supply as such, the toner is charged (e.g., positively charged), at least in part, by friction between the supply roller 33 and the developer roller 31. As the developer roller 31 rotates, toner supplied onto the developer roller 31 enters between the press section 40 of the film thickness restriction blade 32 and the developer roller 31. The toner layer is made thin, flat, and of constant thickness on the developer roller 31 by the film thickness restriction blade 32.

The drum cartridge 26 of this example process cartridge 17 is configured to include: a cartridge frame 51; the photoconductive drum 27 disposed in the cartridge frame 51; a scorotron charger 29; an image transfer roller 30; and a cleaning brush 64.

At the rear of the developer roller 31, the photoconductive drum 27 is disposed to face the developer roller 31, and the drum 27 is rotatably supported by the drum cartridge 26. This photoconductive drum 27 includes a tube-shaped drum body with a metal drum shaft 27*a* at its axial center to support the drum body. The surface of the drum body of this illustrated example photoconductive drum structure 27 is formed with or to include a positively-charged photosensitive layer made of polycarbonate or other suitable material. The photoconductive drum 27 is rotated and driven in the direction of the arrow in FIG. 1 (clockwise direction) in response to power input from the main motor 66.

The scorotron charger 29 is disposed above and facing the photoconductive drum 27, spaced from the photoconductive drum 27 by a predetermined space (e.g., to prevent contact therewith). The scorotron charger 29 is supported by the drum cartridge 26. While other structures and arrangements are possible, in this illustrated example, the scorotron charger 29 produces a positive charge, causing a corona discharge from a charged wire 29*a* (e.g., made of tungsten). A grid 29*b* is provided between the charged wire 29*a* and the photoconductive drum 27, and this grid 29*b* functions to positively and uniformly charge the surface of the photoconductive drum 27. A bias voltage from the bias application circuit 71 described above is applied to the wire 29*a*.

When it is rotated, the surface of the photoconductive drum 27 is uniformly and positively charged by the scorotron charger 29. Once charged, the drum 27 is exposed to light by the high-speed scanning of the laser beam coming from the scanner section 16. During scanning, the laser beam is modulated based on the image data, and in this manner the modulated laser beam selectively exposes and alters the charge on portions of the surface of the photosensitive drum 27. Thus, as a result of this light (laser beam) exposure, electrostatic latent images are formed on the photosensitive drum 27 based on the image data.

Thereafter, as the developer roller 31 rotates, the positively-charged toner on the surface of the developer roller 31 comes in contact with the photoconductive drum 27. With such contact, toner is supplied to the photoconductive drum 27 and selectively adheres to the electrostatic latent images formed on the surface of the photoconductive drum 27. In this manner, the toner makes the electrostatic latent images visible, and thus the images are developed.

An image transfer roller 30 is disposed below and faces the photoconductive drum 27 (and it may be rotatably supported by the drum cartridge 26). The image transfer roller 30 of this example structure is configured as a metal roller shaft 30*a* covered by a roller or sleeve made from a conductive rubber or foam material. At the time of image transfer, an image transfer bias is applied to the image transfer roller 30 by the bias application circuit 71 described above. This image transfer roller 30 is rotated and driven in the direction of the arrow shown in FIG. 1 (counterclockwise direction) in response to power input from the main motor 66.

The cleaning brush 64 is disposed opposing the drum body of the photoconductive drum 27 and in contact therewith. The cleaning brush 64 is constructed as or includes a conductive member to which a cleaning bias voltage may be applied by the bias application circuit 71. The cleaning brush 64 serves to electrically absorb and/or remove any negatively-charged paper dust, excess toner, or other material attached to the photoconductive drum 27.

c. Fixing Section

As shown in FIG. 1, the fixing section 18 is provided to the rear of the process cartridge 17 on the downstream side with respect to a sheet transfer direction. The fixing section 18 of this example printer structure 1 includes: a heating roller 41; a press roller 42 that presses against the heating roller 41; and a pair of paper conveyance rollers 43 located downstream of the heating roller 41 and the press roller 42. At the fixing section 18, the toner transferred onto the paper 3 (or other sheet material) by the process cartridge 17 is thermally fixed while the paper 3 passes between the heat roller 41 and the press roller 42. The paper 3 is then conveyed to a paper ejection path 44 by the convey rollers 43, forwarded to a pair of paper ejection rollers 45, and then onto a paper ejection tray 46 (or optionally back into the printer body frame 2 for printing on its back side and/or inversion, if necessary).

3. Electronic Configuration of Laser Printer in its Entirety

Figure 2:
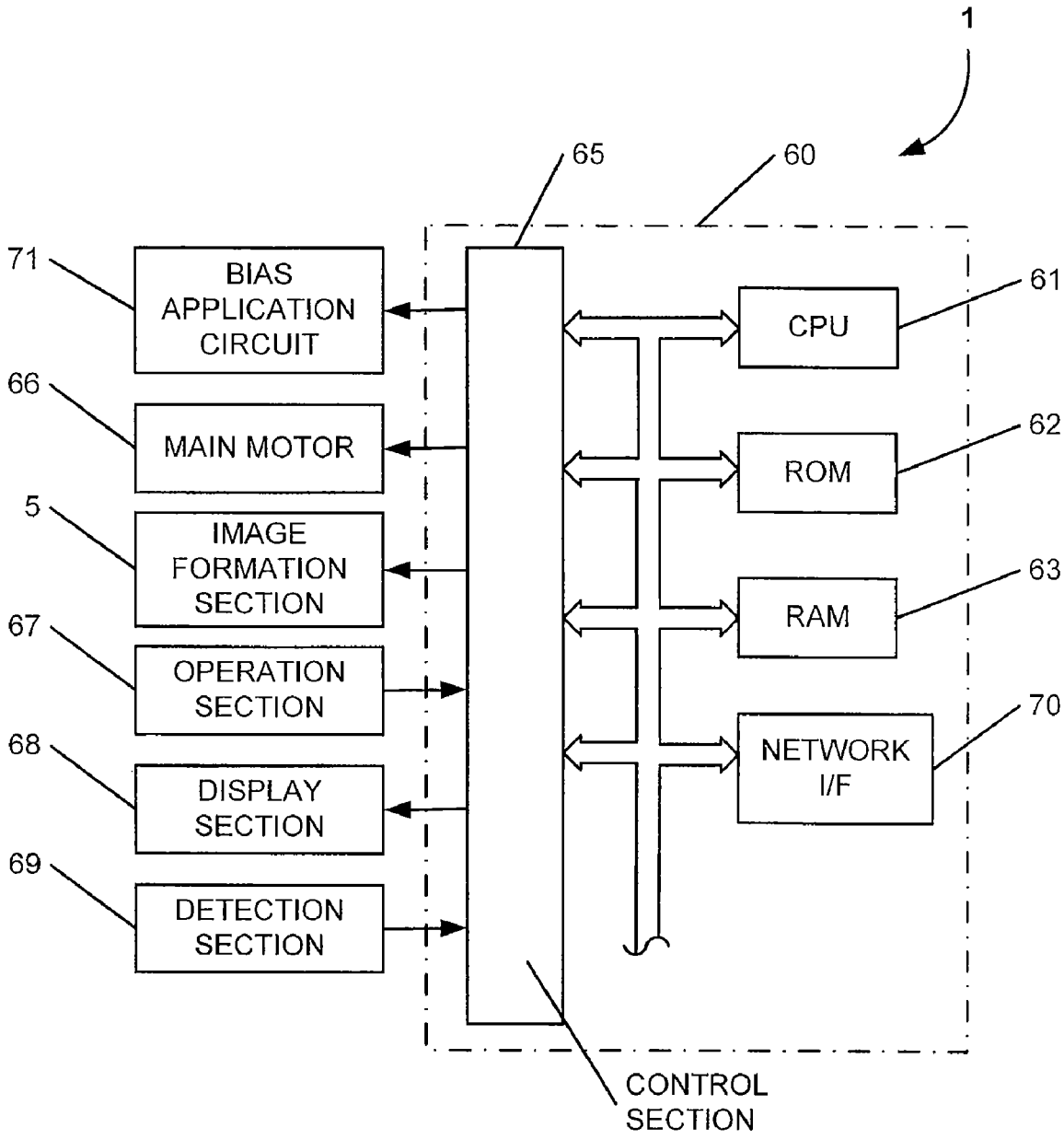
FIG. 2 is a block diagram showing an example electronic configuration of a laser printer according to this invention.

The electronic configuration of the illustrated example laser printer 1 is described in more detail below with the aid of the conceptual block diagram of FIG. 2.

In the laser printer 1, a control device 60 exercising control over various components includes: a CPU (Central Processing Unit) 61, a ROM (Read Only Memory) 62, a RAM (Random Access Memory) 63, and a control section 65 (e.g., an ASIC (Application-Specific Integrated Circuit) in this illustrated example). The control section 65 is electrically connected to various components, e.g., the main motor 66, a main power supply switch (not shown), an operation section 67, a display section 68, a detection section 69, and the bias application circuit 71. The operation section 67 includes various types of user-operable keys, the display section 68 includes a liquid crystal panel or other suitable display system, and the detection section 69 includes various types of sensors.

The ROM 62 and the RAM 63 both are connected to the CPU 61, and the CPU 61 follows the process procedure stored in the ROM 62 and stores the process results in the RAM 63. At the same time, the CPU 61 exercises control over the various components described above via the control section 65.

The main motor 66 is a motor that drives, in synchronization and under the proper timing, the developer roller 31, the agitator 36, the photoconductive drum 27, the image transfer roller 30, the heating roller 41, the resist roller 12, and others. The CPU 61 follows a program stored in the ROM 62 to drive and control the main motor 66.

The control section 65 follows commands coming from the CPU 61 and exercises control over the image formation section 5. More specifically, for example, the control section 65 applies light exposure control, i.e., for exposing the surface of the photoconductive drum 27 to light by the components making up the scanner section 16. The control section 65 also exercises control over the bias application circuit 71 that is in charge of applying bias voltages to various components. For example, the control section 65 makes the bias application circuit 71 apply a bias voltage, at the appropriate times, to the developer roller 31, for developing the electrostatic latent images on the photoconductive drum 27.

The control device 60 includes a network interface ("network I/F") 70 for establishing connections with external equipment, e.g., a personal computer, laptop, print server, router, etc. With the above-described drive control over the components, the CPU 61 goes through a process of forming, on the paper 3 (on a recording surface thereof), images based on image data provided over the network I/F 70.

The detection section 69 of this example printer structure 1 includes: a cover open/close sensor; an old/new condition determination sensor; a toner supply amount detection sensor; and other various types of sensors, all of which may be electrically connected to the control section 65. The cover open/close sensor detects the state of the front cover 2*a*, i.e., whether the front cover 2*a* is open or closed. The old/new condition determination sensor detects whether the developer cartridge 28 is in old or new condition. Such a determination may be made, for example, based on the position of an old/new condition indication member (not shown in FIG. 1) provided with the developer cartridge 28. The toner supply amount detection sensor detects the amount of toner remaining in the developer cartridge 28. Of course, other sensing systems may be provided and controlled by control section 65 without departing from this invention.

4. Configuration of Electrode Displacement Mechanism and Neighboring Parts

Figure 3:
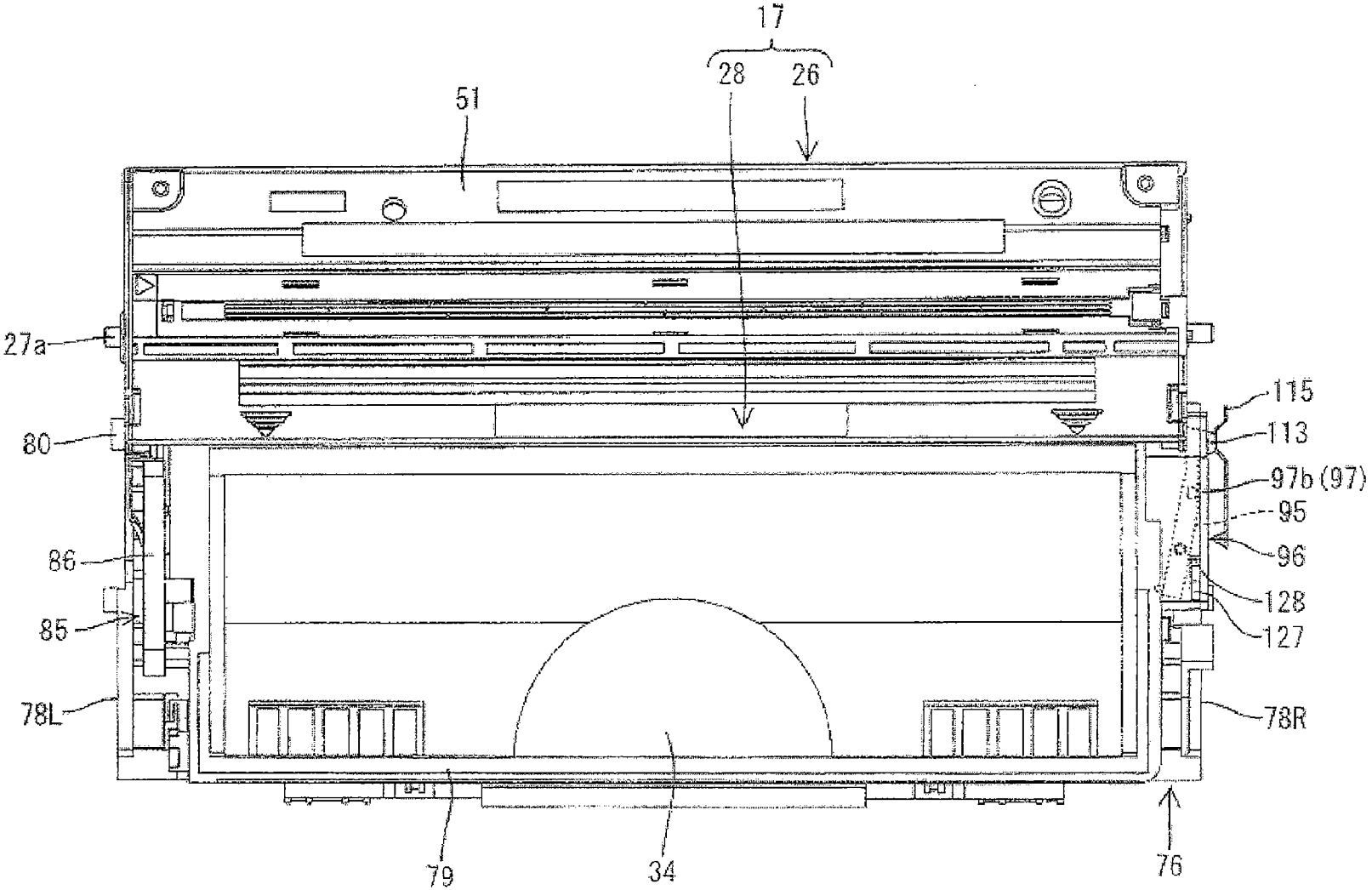
FIG. 3 is a plane view of an example process cartridge including one or more aspects or features of the present invention.
Figure 4:
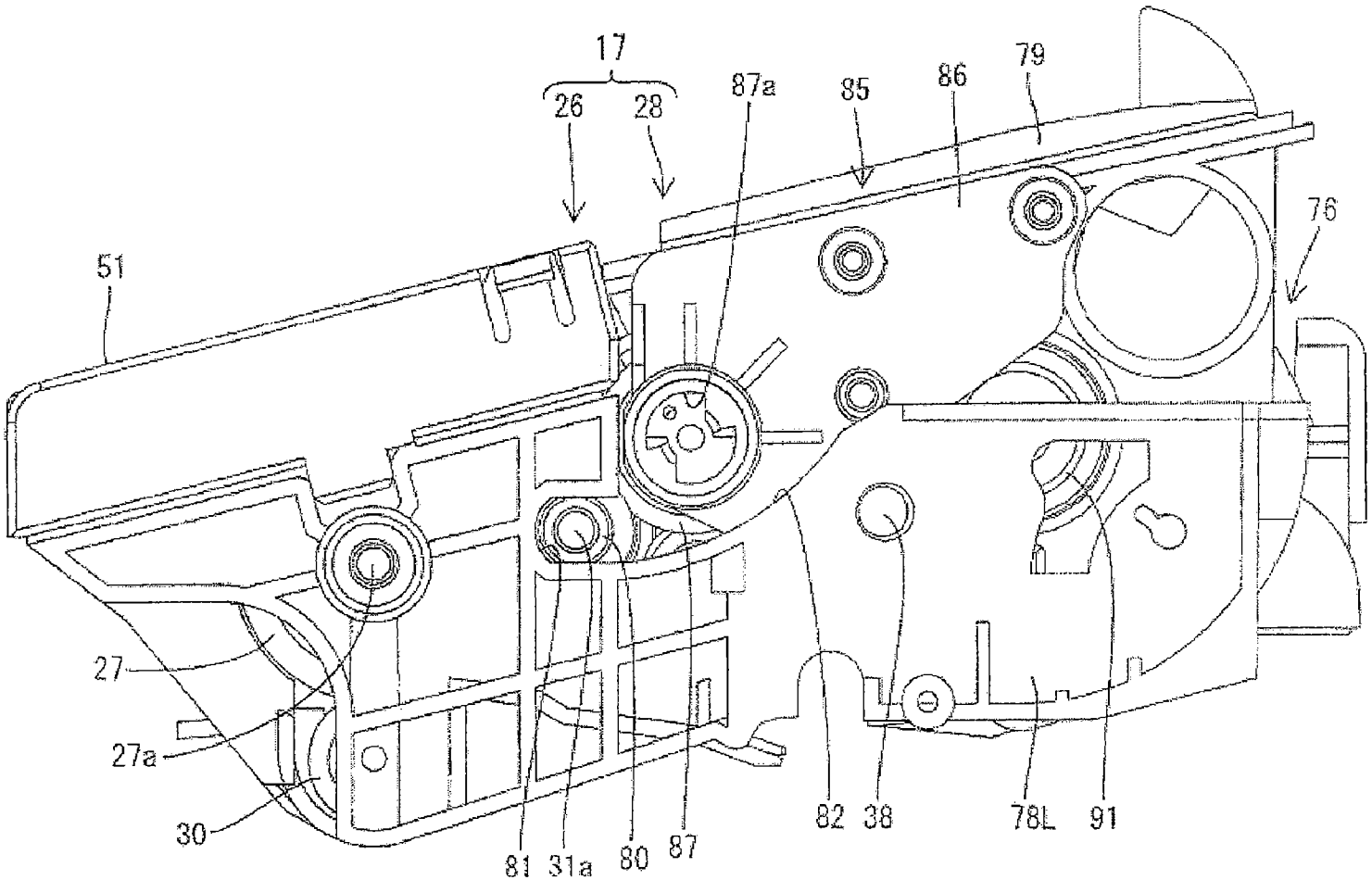
FIG. 4 is a left side view of the example process cartridge of FIG. 3.
Figure 5:
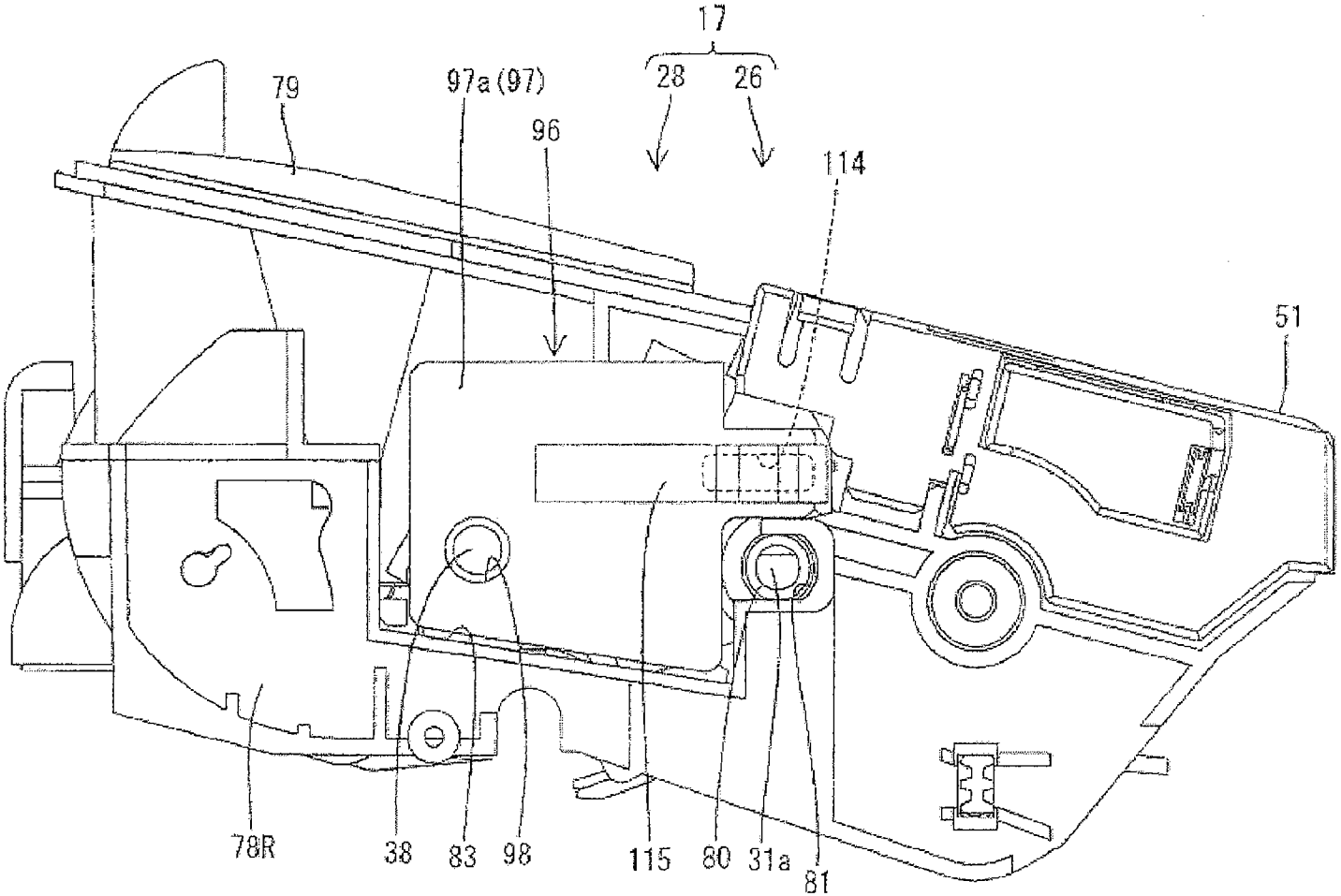
FIG. 5 is a right side view of the example process cartridge of FIG. 3.
Figure 6:
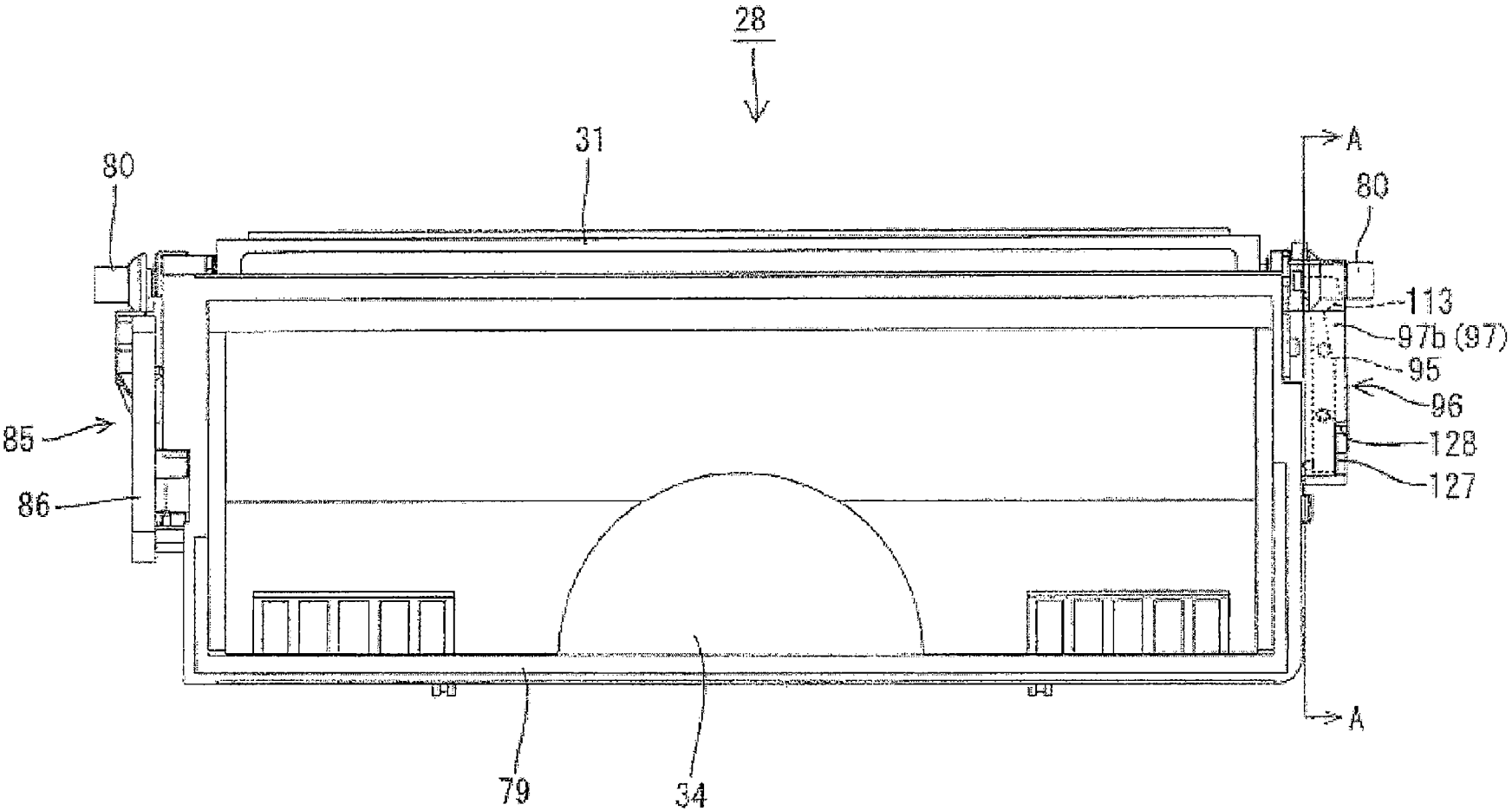
FIG. 6 is a plane view of an example developer cartridge including one or more aspects or features of the present invention.
Figure 7:
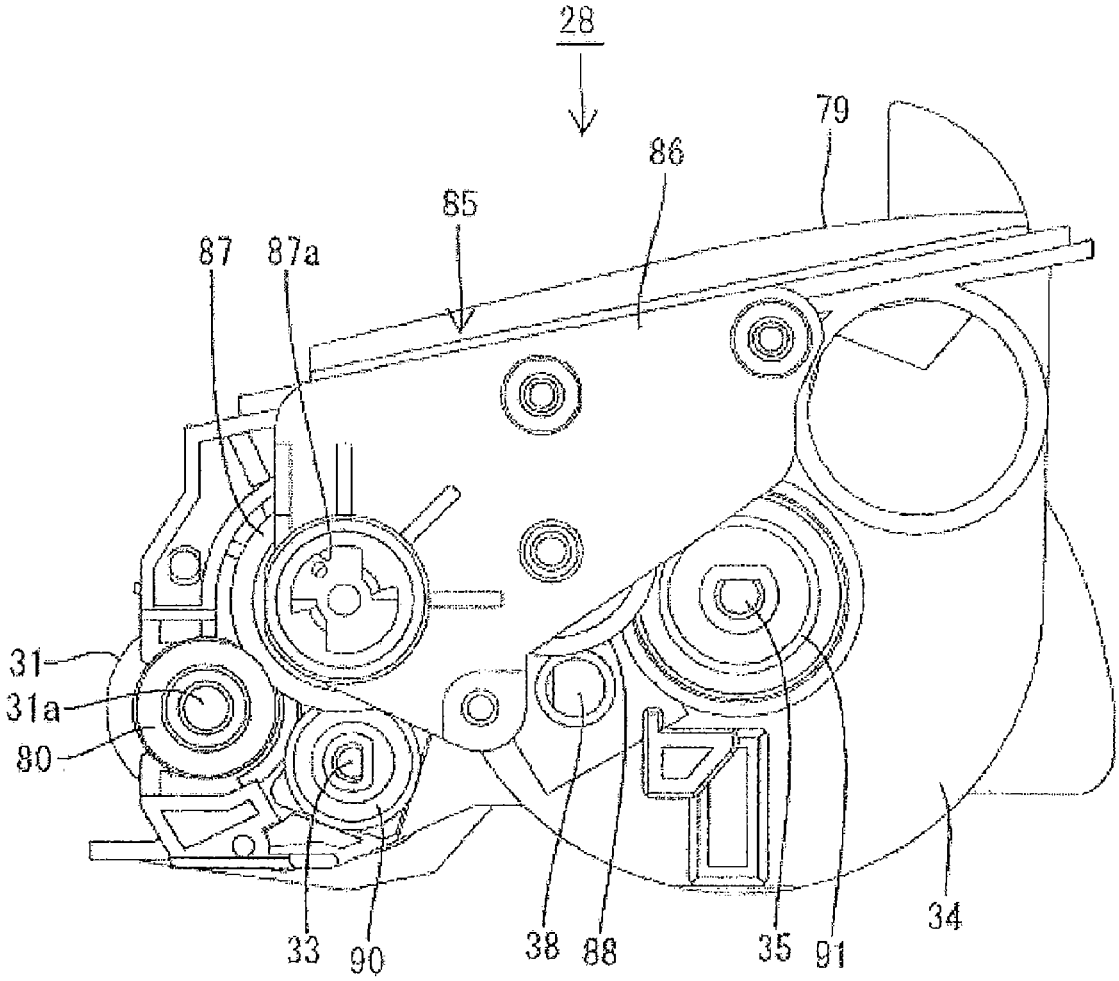
FIG. 7 is a left side view of the example developer cartridge of FIG. 6.

The configuration of an electrode displacement mechanism 96 provided with the developer cartridge 28 (as well as its neighboring parts) will now be described. This description will be provided in conjunction with FIGS. 3-7. FIG. 3 is a plane view of the process cartridge 17, FIG. 4 is a left side view of the process cartridge 17 (viewed from the front side of FIG. 1), and FIG. 5 is a right side view of the process cartridge 17 (viewed from the back side of FIG. 1). FIG. 6 is a plane view of the developer cartridge 28, and FIG. 7 is a left side view of the developer cartridge 28. Notably, for convenience of description, FIGS. 3 and 5 each also show a power supply electrode 115 (as will be described in more detail later) provided in the body frame 2.

As shown in FIGS. 3 to 5, the cartridge frame 51 of the drum cartridge 26 includes, at its substantially front half portion, a cartridge housing section 76 for housing (at least partially) therein or thereon the developer cartridge 28. The cartridge housing section 76 is shaped to open upward, and it is provided with a pair of side plates 78R and 78L that are disposed so as to at least partially cover the developer cartridge 28 from the right and left sides. The developer cartridge 28 includes a cabinet or housing 79 made of insulative synthetic resin. As shown in FIGS. 6 and 7, the roller shaft 31*a* of the developer roller 31 protrudes from the right and left side surfaces of the cabinet 79, and a tube-shaped collar 80 is attached at each of the tip portions of the roller shaft 31*a*. As shown in FIGS. 4 and 5, the side plates 78R and 78L of the cartridge frame 51 are each formed with a cartridge attachment groove 81. The cartridge attachment groove 81 is shaped to accept the corresponding collar 80 protruding from the cabinet 79 of the developer cartridge 28. As shown in FIG. 4, the side plate 78L (located on the left side when viewed from the front of the cartridge frame 51) is formed with a guide edge portion 82. The guide edge portion 82 is of substantially arcuate shape and extends from the lower edge portion of the cartridge attachment groove 81. When one of the collars 80 slides along the guide edge portion 82 toward the corresponding cartridge attachment groove 81, the developer cartridge 28 is guided to its normal attachment position, and when both of the collars 80 are received inside their respective cartridge attachment grooves 81 (and optionally snapped or otherwise secured in place), the developer cartridge 28 is correctly positioned. With the developer cartridge 28 positioned as such, the developer roller 31 and the photoconductive drum 27 face and abut each other. As shown in FIG. 5, the right side plate 78R of the cartridge frame 51 is formed with an acceptance concave section 83 to accept therein the electrode displacement mechanism 96, which will be described later.

As shown in FIG. 7, on the left side surface (when viewed from the front) of the cabinet 79 of the developer cartridge 28 (i.e., one end of the developer roller 31 in the axial direction), a driving force transmission section 85 is provided to transfer driving force from the main motor 66 to the developer roller 31 and/or to other portions of the overall printer 1. This driving force transmission section 85 is at least partially covered by a gear cover 86, and inside the gear cover 86, various gears and other structures are provided. For example, in this illustrated system, the driving force transmission section 85 includes a driving force transmission gear 87, an intermediate gear 88 (for engaging the driving force transmission gear 87), and an old/new condition indication member (not shown in detail in these figures). The driving force transmission gear 87 includes a coupling section 87*a* for coupling with an input gear (not shown), which is retractable inside the body frame 2. The coupling section 87*a* is exposed outside the gear cover 86. The driving force transmission gear 87 meshes with both a developer roller gear (not shown) and a supply roller gear 90, and it is coupled with an agitator axis gear 91. The developer roller gear is attached to the roller shaft 31*a* of the developer roller 31, and the supply roller gear 90 is attached to the roller shaft of the supply roller 33. The agitator axis gear 91 is attached to the rotation shaft 35 of the agitator 36 and is engaged with the driving force transmission gear 87 via the intermediate gear 88. When the input gear coupled to the coupling section 87*a* of the driving force transmission gear 87 is driven in response to power from the main motor 66, the various components, e.g., the developer roller 31, the supply roller 33, and the agitator 36, are accordingly rotated and driven.

Figure 8:
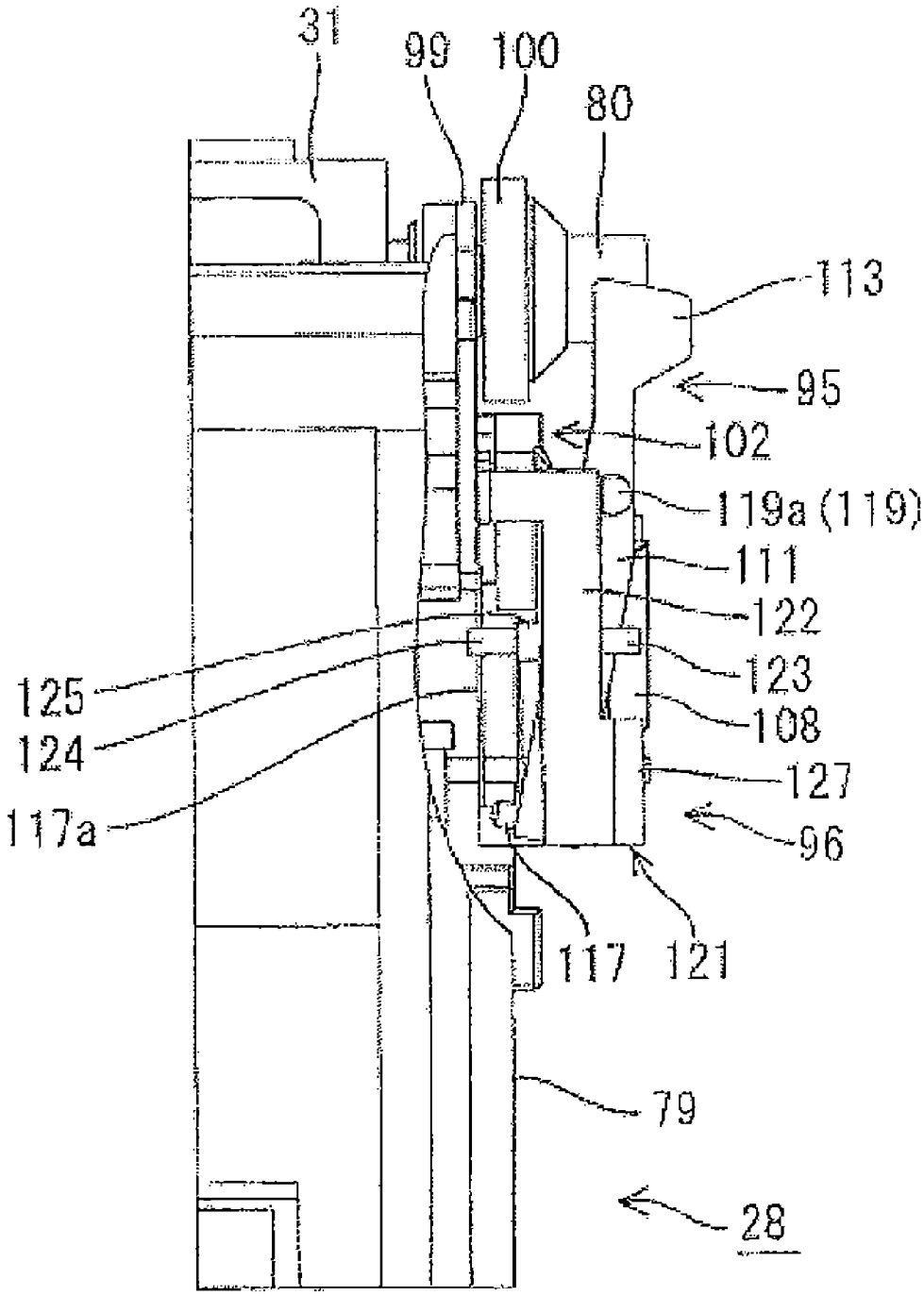
FIG. 8 is a partially-cutaway plane view of an example electrode displacement mechanism that may be used in some example structures according to this invention.
Figure 9:
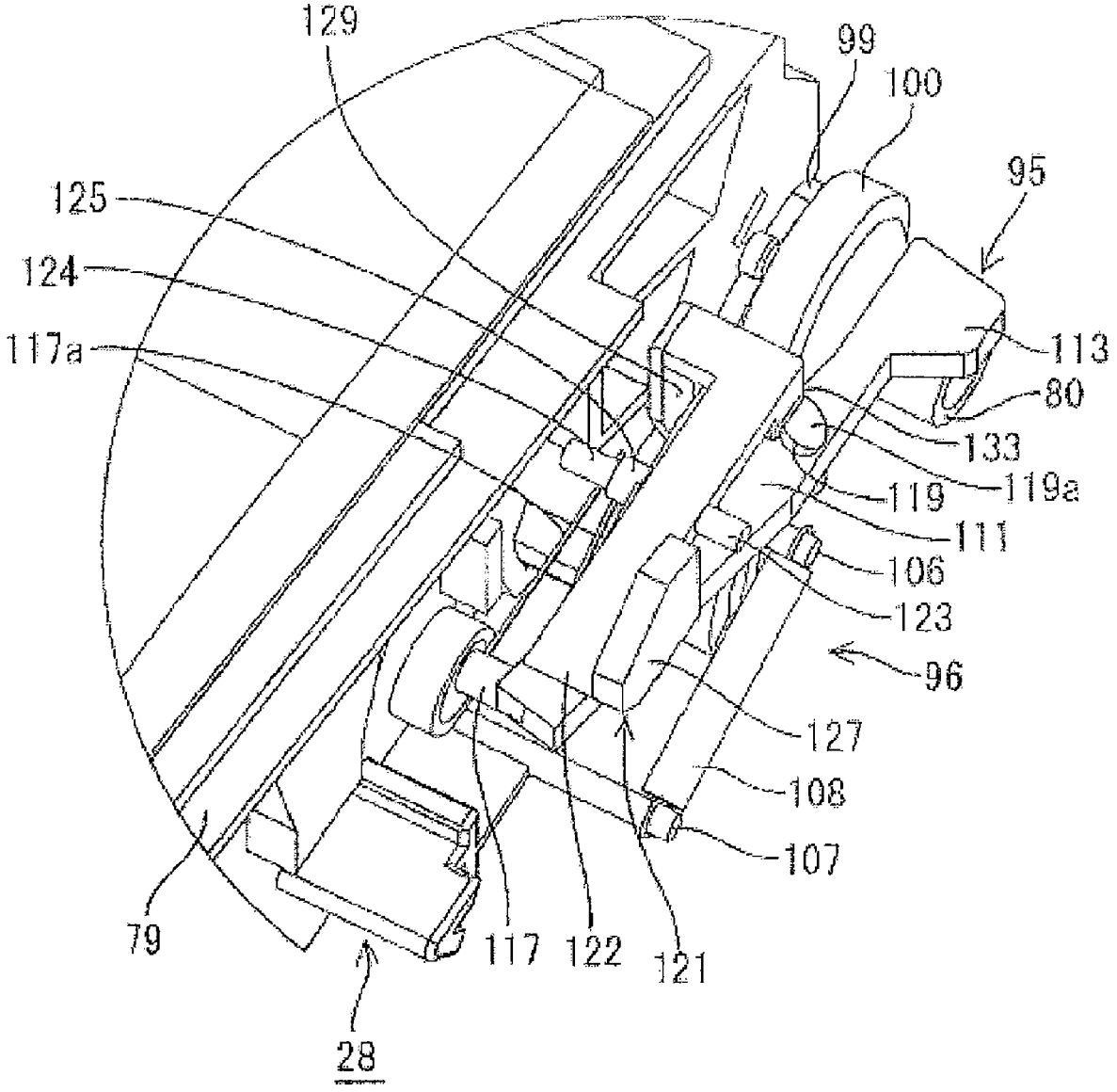
FIG. 9 is a perspective view of the example electrode displacement mechanism of FIG. 8.
Figure 10:
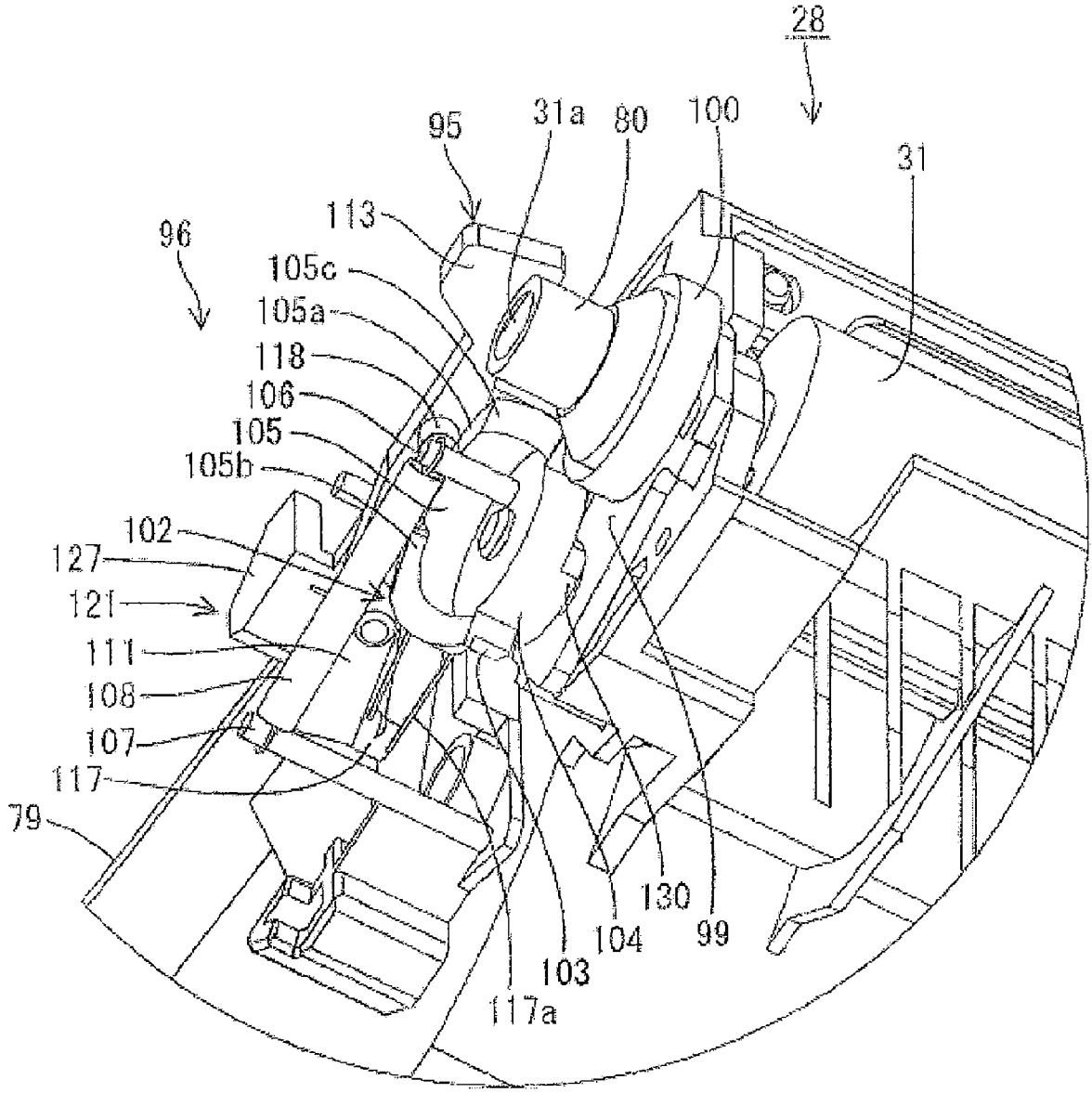
FIG. 10 is another perspective view of the example electrode displacement mechanism of FIG. 8.
Figure 11:
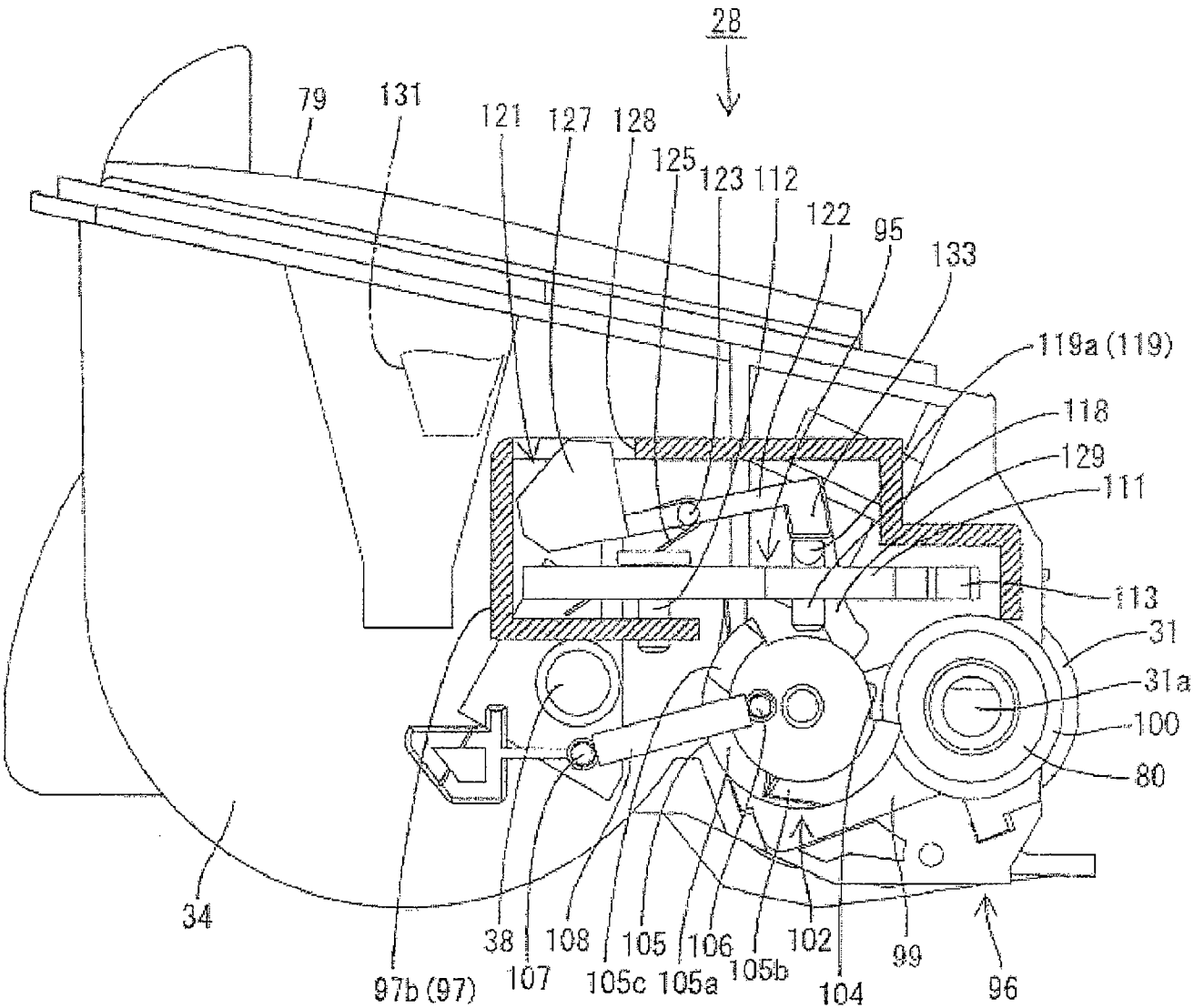
FIG. 11 is a cross sectional view of the example electrode displacement mechanism of FIG. 8 when viewed from the right (outside)
Figure 12:
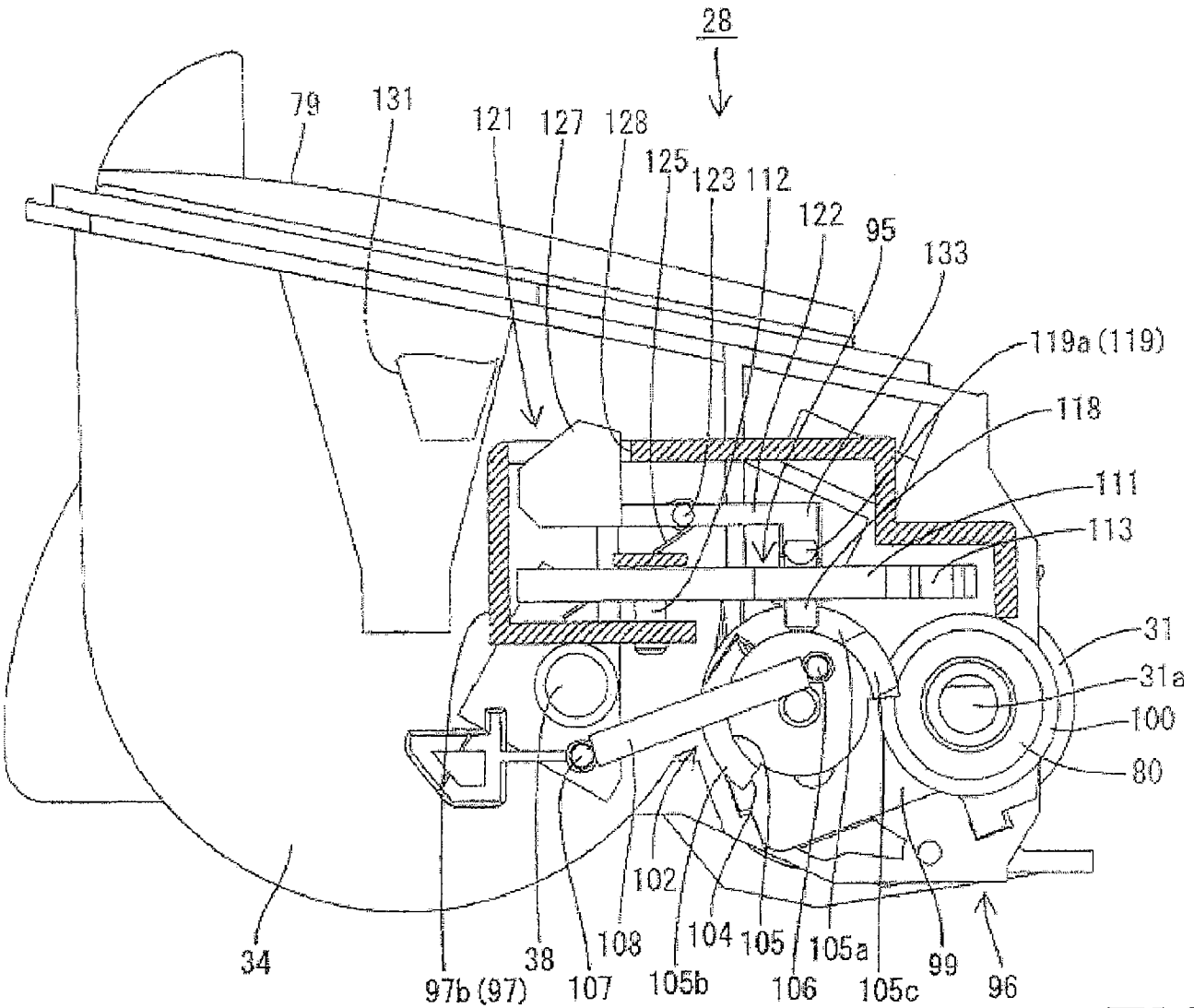
FIG. 12 is another cross sectional view of the example electrode displacement mechanism of FIG. 8 when viewed from the right (outside)
Figure 13:
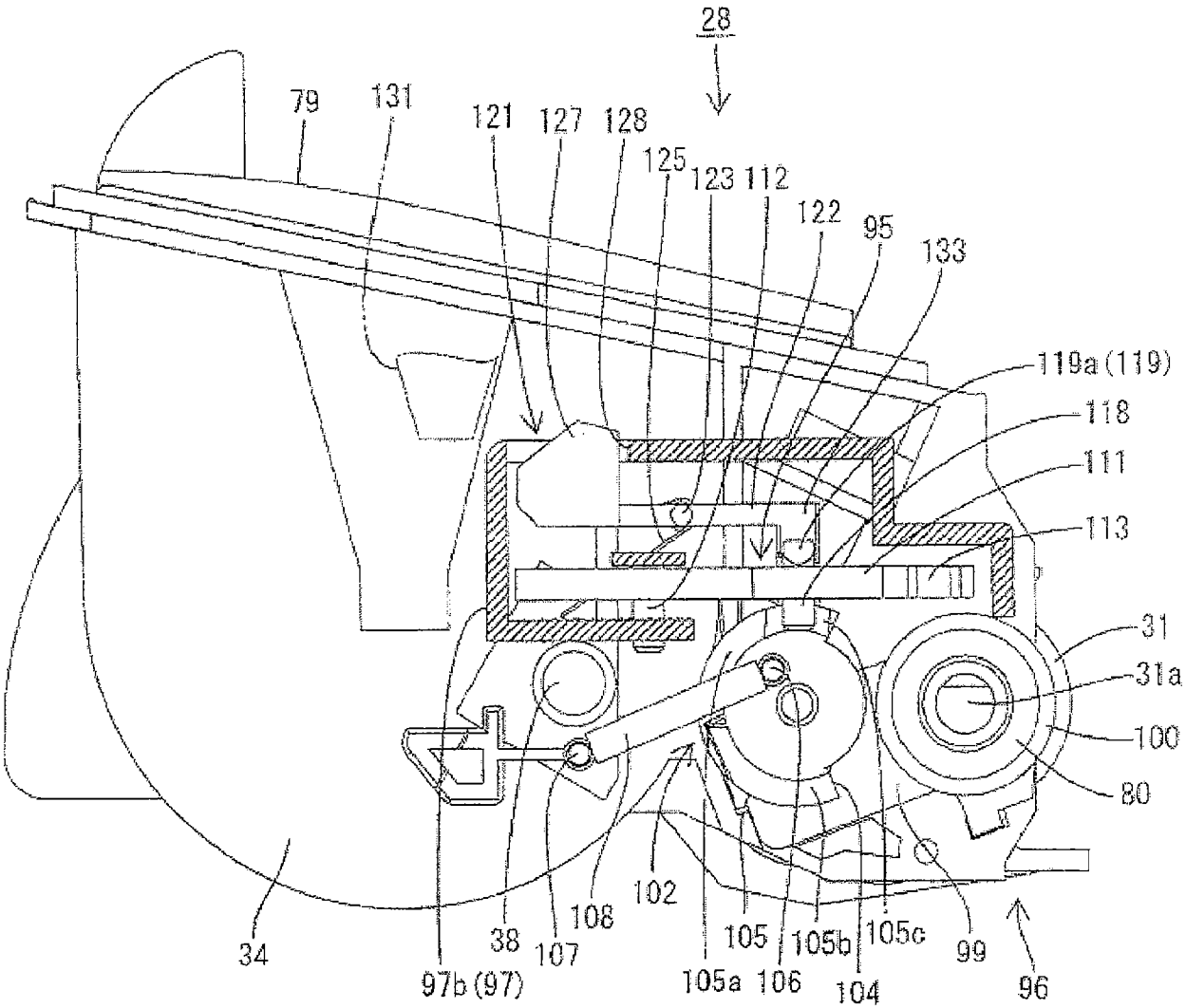
FIG. 13 is still another cross sectional view of the example electrode displacement mechanism of FIG. 8 when viewed from the right (outside)
Figure 15:
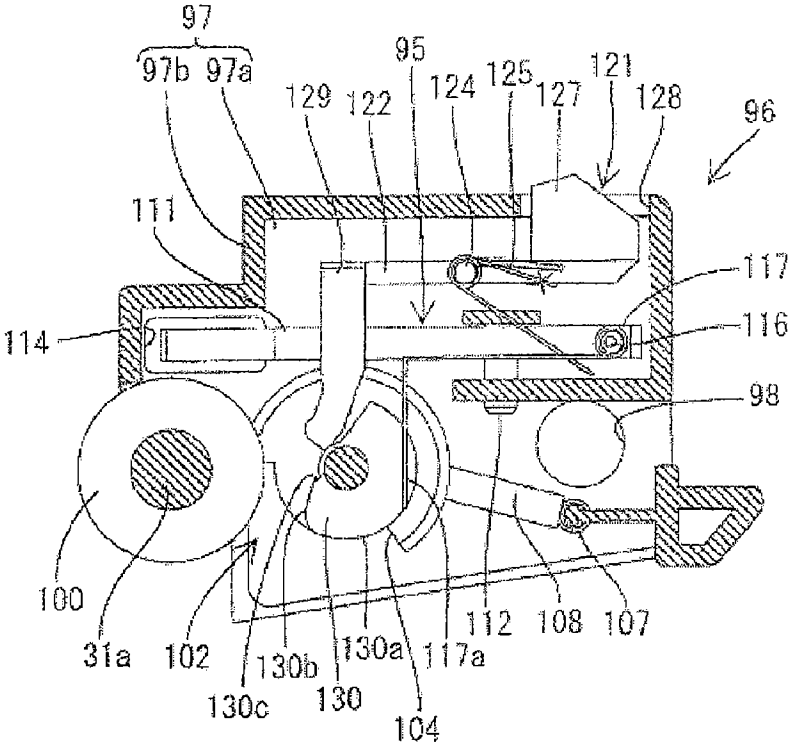
FIG. 15 is another cross sectional view of the example electrode displacement mechanism of FIG. 8 when viewed from the left (inside)
Figure 14:
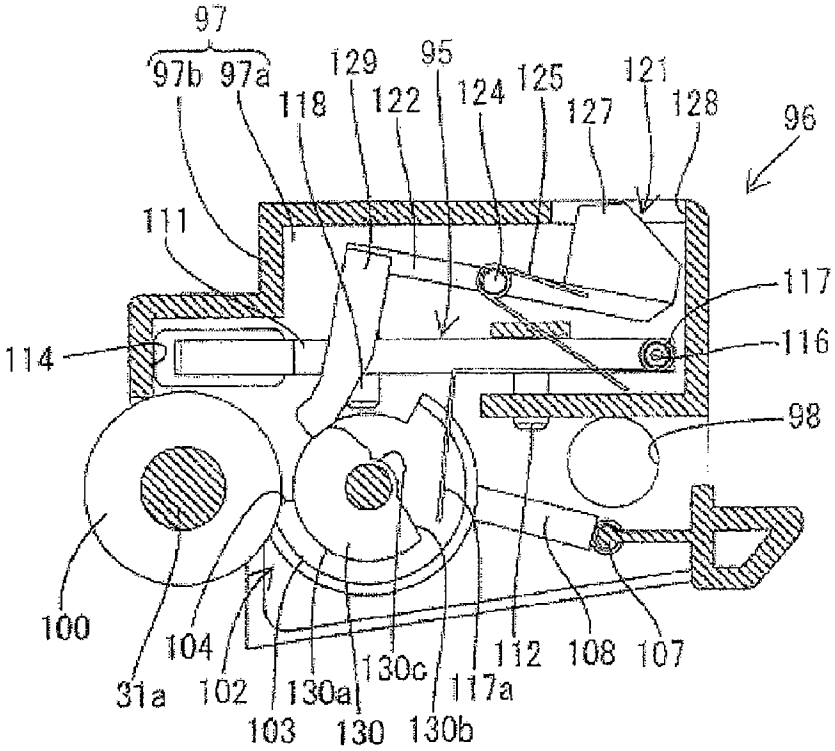
FIG. 14 is a cross sectional view of the example electrode displacement mechanism of FIG. 8 when viewed from the left (inside)
Figure 16:
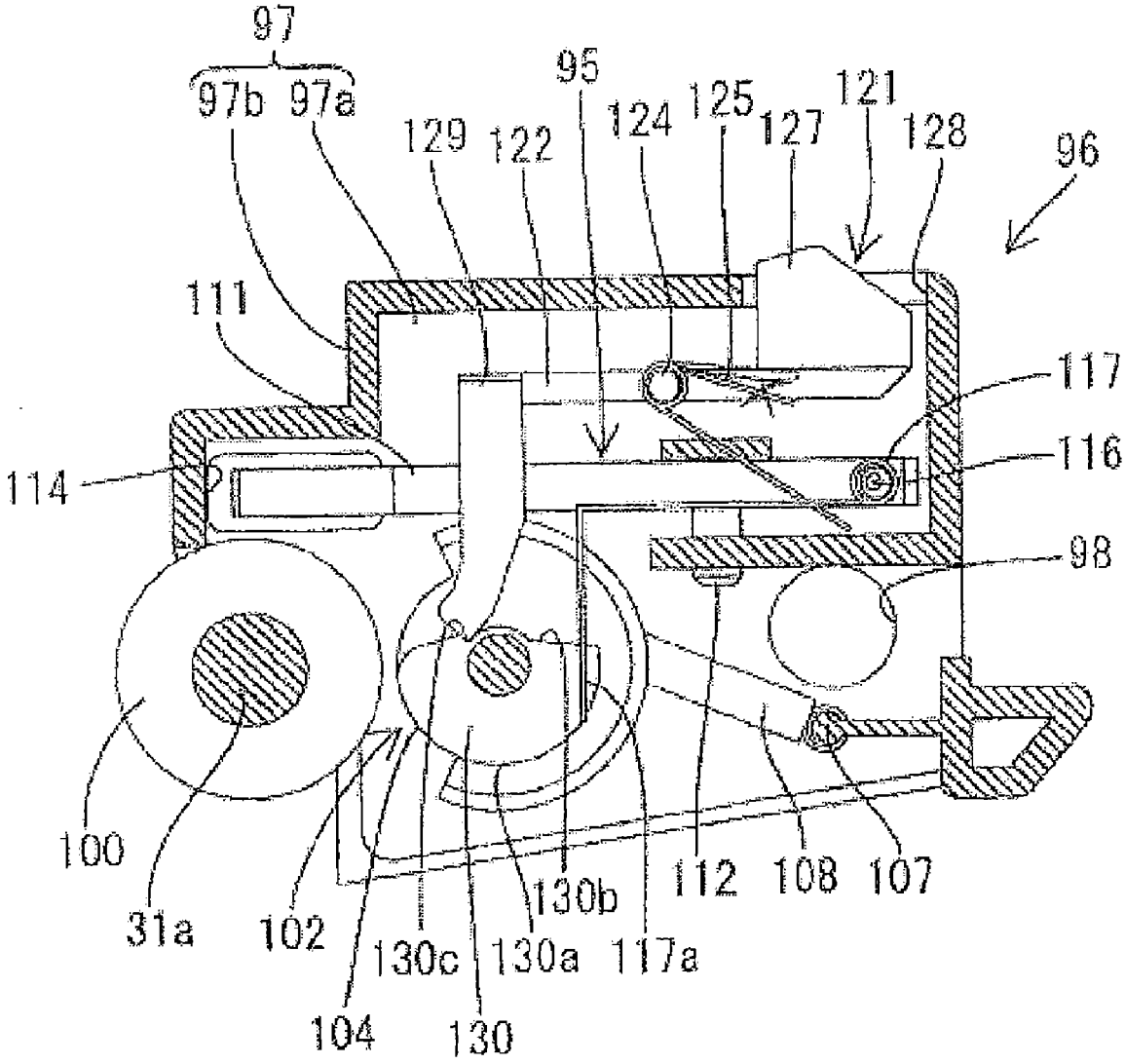
FIG. 16 is still another cross sectional view of the example electrode displacement mechanism of FIG. 8 when viewed from the left (inside)

FIG. 8 is a partially-cutaway plane view of the electrode displacement mechanism 96, FIG. 9 is a perspective view of the electrode displacement mechanism 96 when viewed from above, and FIG. 10 is a perspective view of the electrode displacement mechanism 96 when viewed from below. FIGS. 11 to 13 are all cross sectional views of the electrode displacement mechanism 96 when viewed from the right (outside), and FIGS. 14 to 16 are all cross sectional views of the electrode displacement mechanism 96 when viewed from the left (inside), i.e., cross sectional views cut along line A-A of FIG. 6. Notably, FIGS. 11 to 13 each show a release protrusion 131 (which will be described later) provided in the body frame 2. In the description below about the electrode displacement mechanism 96, the right side may be referred to as "outside," and the left side may be referred to as "inside."

On the right side surface (when viewed from the front) of the cabinet 79 of the developer cartridge 28 (i.e., an end portion opposite to the driving force transmission section 85 of the developer roller 31 in the axial direction), a developer electrode 95 and the electrode displacement mechanism 96 are provided. The developer electrode 95 is provided for establishing an electrical connection between the developer roller 31 and the bias application circuit 71 of the body frame 2, and the electrode displacement mechanism 96 is provided for displacing the developer electrode 95.

As shown in FIGS. 5, 14, and others, the electrode displacement mechanism 96 is provided with a cover member 97 that covers the developer electrode 95 and other components. Note that FIGS. 8 to 10 do not show the cover member 97. This cover member 97 includes a side plate 97*a* and a frame section 97*b*, and it is attached to the right side surface of the cabinet 79 (and forms a part of the overall developer cartridge housing). The side plate 97*a* is substantially rectangular shaped, and it covers the side of the electrode displacement mechanism 96. The frame section 97*b* is narrow and slim in the fore-and-aft direction, and it protrudes inward from the substantially upper half portion of the side plate 97*a*. The side plate 97*a* includes a through hole 98 at a position corresponding to the window section 38 of the toner accommodating section 34 to allow sensor light from the toner supply amount detection sensor to pass.

As shown in FIG. 10 and others, the roller shaft 31*a* of the developer roller 31 goes through the right side wall of the cabinet 79 and is pivotally supported thereby. The upper surface of the right side wall includes a conductor plate 99 that is electrically connected to the roller shaft 31*a*. The tip end portion of the roller shaft 31*a* includes the collar 80 described above, and a developer roller shaft gear 100 is attached between the collar 80 and the conductor plate 99.

As shown in FIGS. 10, 11, and others, the front side of the developer roller shaft gear 100 is rotatably engaged with a cam gear 102. This cam gear 102 is a so-called "intermittent gear," and it includes a tooth section 103 and a chipped tooth section 104 at the rim portion. When the tooth section 103 faces and meshes with the developer roller gear 100, the cam gear 102 is rotatably coupled to the roller shaft 31*a*. When the chipped tooth section 104 faces the developer roller gear 100, the cam gear 102 is free from the coupling with the roller shaft 31*a*. The cam gear 102 includes a press section 105 that protrudes, with an arc-shaped cross section, toward the outer surface of the tooth section 103. This press section 105 functions to press and displace the developer electrode 95, which will be described later. The press section 105 includes a flat section 105*a* and a pair of sloped sections 105*b* and 105*c* that sandwich therebetween the flat section 105*a*. The degree of protrusion of the flat section 105*a* is constant, and the degree of protrusion of the sloped sections 105*b* and 105*c* gradually reduces as the sections extend away from the flat section 105*a*. A spring attachment pin 106 extends from the outer surface of the cam gear 102, and a cam gear bias spring, under tension, extends between the spring attachment pin 106 and another spring attachment pin 107. The spring attachment pin 107 protrudes from the lower side portion of the window section 38 on the right side surface of the cabinet 79. With the tension of the cam gear bias spring 108, the cam gear 102 is biased to the side of an initial position (refer to FIG. 11) at which one end portion of the tooth section 103 is meshed with the developer roller gear 100.

The developer electrode 95 is a component made of conductive synthetic resin, and as shown in FIGS. 9, 11, and others, this example electrode 95 includes a body section 111 that is flat and narrow and slim in the fore-and-aft direction. An attachment pin 112 protrudes downward from the body section 111 at a position closer to the front end than the center in the longitudinal direction. This attachment pin 112 is engaged, from above, with a through hole (not shown) formed in the lower surface of the frame section 97*b* of the cover member 97. With such a configuration, the developer electrode 95 is supported and is rotatable in the horizontal direction about the attachment pin 112. An end portion of the body section 111 opposite to the attachment pin 112 includes a contact point section 113 that protrudes outward, i.e., rightward. As shown in FIG. 14, the side plate 97*a* of the cover member 97 is formed to include an electrode aperture section 114 at a position corresponding to the contact point section 113. The developer electrode 95 is allowed to displace between a connection position and a retract position. At the connection position, as shown in FIG. 3, the contact point section 113 protrudes from the electrode aperture section 114 and extends outside the side plate 97*a*. At the retract position, as shown in FIG. 6, the contact point section 113 is retracted, optionally located at least partially inside the side plate 97*a*. As shown in FIGS. 3 and 5, the body frame 2 includes therein a power supply electrode 115 that comes in contact with the contact point section 113 of the developer electrode 95 when the developer electrode is at the connection position. This power supply electrode 115 is electrically connected to the bias application circuit 71 described above.

As shown in FIGS. 9 and 14, a spring attachment protrusion 116 protrudes inward at an end portion of the body section 111 of the developer electrode 95 opposite to the contact point section 113. An electrode bias spring 117 attaches at the rim of this spring attachment protrusion 116 (the electrode bias spring 117 may be made of a conductive metal material). The electrode bias spring 117 of this illustrated example is a compression coil spring, and from one end thereof, an L-shaped leg section 117*a* extends. The tip end portion of the leg section 117*a* is fixed onto the conductor plate 99 described above, i.e., in the example structure illustrated in FIG. 14, and the conductor plate 99 is disposed at the front of the leg section 117*a*. The developer electrode 95 is biased (depressed) by the electrode bias spring 117 in the direction from the connection position side toward the retract position side. The developer electrode 95 is electrically connected to the roller shaft 31*a* of the developer roller 31 via the electrode bias spring 117 and the conductor plate 99.

As shown in FIGS. 10 and 11, the body section 111 of the developer electrode 95 is formed with a cam pin 118 at a position in the middle between the attachment pin 112 and the contact point section 113. The cam pin 118 protrudes downward. As shown in FIG. 11, when the cam gear 102 is located at the initial position, the cam pin 118 is at a position not overlaid with the press section 105, and the developer electrode 95 is at the retract position. As the cam gear 102 rotates, the sloped section 105*b* of the press section 105 presses outward on the cam pin 118, and when the cam pin 118 reaches the flat section 105*a* of the press section 105, the developer electrode 95 extends to the connection position.

As shown in FIG. 9, the body section 111 of the developer electrode 95 includes a latch pin 119 protruding on the upper surface side of the cam pin 118. This latch pin 119 is configured so as to be engageable with a stopper 121 that will be described below, and the upper surface of the latch pin 119 is formed with a guide surface 119*a* that is sloped so as to protrude more toward the inside.

As shown in FIGS. 9, 11, and 14, the stopper 121 is a synthetic resin component that includes a base section 122 that is narrow and slim in the substantially fore-and-aft direction. At a substantially center portion of the base section 122 in the longitudinal direction, an attachment pin 123 and a spring attachment pin 124 are provided on the same axis. The attachment pin 123 protrudes toward the outer side surface of the base section 122, and the spring attachment pin 124 protrudes toward the inner side surface thereof. When the attachment pin 123 is attached to a bearing section (not shown) provided at the inner surface of the side plate 97*a* of the cover member 97, the stopper 121 is supported so as to be rotatable about the attachment pin 123. The spring attachment pin 124 engages a torque spring 125, by which the stopper 121 is biased in the counterclockwise direction of FIG. 14.

The front end portion of the base section 122 includes a plate-like abutment protrusion 127 that protrudes upward from the outer side surface. The upper surface of the frame section 97*b* of the cover member 97 is formed with a stopper aperture section 128 that can be inserted into the abutment protrusion 127. The rear end portion of the base section 122 includes an extension piece 129 that extends downward from the inner side surface. As shown in FIG. 14, the tip end portion of this extension piece 129 abuts the rim surface of a stopper displacement section 130 by the biasing force of the torque spring 125. The stopper displacement section 130 is provided on the inner surface side of the cam gear 102, and it has a substantially half-moon-shaped cross section. The stopper displacement section 130 includes, at the rim portion, an arc section 130*a* and a chord section 130*b*. As shown in FIG. 14, when the tip end portion of the extension piece 129 abuts the arc section 130*a* of the stopper displacement section 130, the stopper 121 is located at a "no-abutting" position, at which the abutment protrusion 127 does not protrude outside of the cover member 97. As shown in FIG. 15, when the tip end portion of the extension piece 129 abuts the chord section 130*b* of the stopper displacement section 130, the stopper 121 is located at a "protruding" position, at which the abutment protrusion 127 protrudes above and outside the cover member 97 through the stopper aperture section 128. The chord section 130*b* of the stopper displacement section 130 is formed with a latch concave section 130*c* to which the tip end portion of the extension piece 129 can be engaged. As shown in FIG. 16, by engaging the extension piece 129 with the latch concave section 130*c*, the stopper 121 can be kept at the protruding position, and the cam gear 102 can remain free from coupling with the roller shaft 31*a* of the developer roller 31.

On the other hand, as shown in FIG. 12, the body frame 2 includes therein a release protrusion 131 located toward the front of the abutment protrusion 127 when the abutment protrusion 127 is located at the protruding position. As the process cartridge 17 is detached from the body frame 2, the release protrusion 131 abuts the tip end portion of the abutment protrusion 127 of the stopper 121 and presses down the abutment protrusion 127 so that the latch is released between the extension piece 129 and the latch concave section 130*c* of the cam gear 102.

As shown in FIG. 9, the rear end portion of the base section 122 of the stopper 121 is formed with a return restriction section 133. The return restriction section 133 protrudes downward, and it is formed on the side surface opposite to the extension piece 129. As shown in FIGS. 9 and 12, when the stopper 121 is located at the protruding position, the return restriction section 133 is latched inside of the latch pin 119 of the developer electrode 95 (which is located at the connection position), and this return restriction section 133 restricts the displacement of the developer electrode 95 to the retract position side. As shown in FIG. 11, when the stopper 121 is located at the no-protrusion position, the return restriction section 133 is moved upward and thus becomes free from the latch with the latch pin 119. In this situation, the developer electrode 95 is allowed to displace to the retract position side.

5. Operation of this Example Device

As shown in FIGS. 11 and 14, when the developer cartridge 28 is not attached to the body frame 2, e.g., before a new developer cartridge 28 is attached to the body frame 2 or after a developer cartridge 28 is detached from the body frame 2, the cam gear 102 is at its initial position, and one end portion of the tooth section 103 is meshed with the developer roller gear 100. In such a coupled state, the tip end of the extension piece 129 of the stopper 121 abuts a position closer to one end of the arc section 130*a* of the stopper displacement section 130 of the cam gear 102. With such abutment, the stopper 121 is located at the no-protrusion position at which the abutment protrusion 127 takes shelter inside the cover member 97. By the biasing force of the electrode bias spring 117, the developer electrode 95 is at the retract position at which the latch pin 119 is beneath the return restriction section 133 of the stopper 121. As shown in FIG. 6, when the developer electrode 95 is at the retract position in this example structure, it is covered by the cover member 97 in its entirety, i.e., it does not protrude outside. If desired, however, the developer electrode 95 may partially protrude outside the cover member 97, even when in the retract position.

After being attached to the drum cartridge 26, the developer cartridge 28 is attached to the inside of the body frame 2 together with the drum cartridge 26 (the combination thereby constituting the process cartridge 17). In the control device 60, when the detection section 69 detects that the main power is turned on or the front cover 2*a* is closed, the input gear is coupled to the coupling section 87*a* of the driving force transmission gear 87 in the driving force transmission section 85, and the main motor 66 is driven for a predetermined length of time. As such, power from the main motor 66 is transmitted to the developer roller 31, the supply roller 33, and the agitator 36 via the driving force transmission section 85, and these components 31, 33, and 36 are rotated and driven.

When the developer roller 31 is rotated and driven in the clockwise direction shown in FIG. 11, the cam gear 102 rotates together with the developer roller 31 but in the counterclockwise direction in the drawing. The cam gear 102 is in the coupled state in which the tooth section 103 is meshed with the developer roller gear 100. When the cam gear 102 rotates by a predetermined amount, the sloped section 105*b* of the press section 105 abuts the cam pin 118 of the developer electrode 95, and with the rotation of the cam gear 102, the cam pin 118 is pressed and displaced toward the outside. When the cam pin 118 moves over the flat section 105*a* of the press section 105, the developer electrode 95 reaches the connection position.

Thereafter, when the extension piece 129 of the stopper 121 abuts the cam gear 102, moves across the arc section 130*a*, and reaches the chord section 130*b* of the stopper displacement section 130, as shown in FIG. 15, the stopper 121 is displaced to the protruded position by the biasing force of the torque spring 125, and the abutment protrusion 127 protrudes through the upper surface of the cover member 97. As a result, the return restriction section 133 of the stopper 121 enters inside the latch pin 119 of the developer electrode 95 and is latched therewith so that the developer electrode 95 is controlled so as not to return to the retract position, i.e., in the states shown in FIGS. 10, 12, and 15.

When the cam gear 102 in such a state rotates to a further degree, the mesh is released between the tooth section 103 of the cam gear 102 and the developer roller gear 100, and the cam gear 102 rotates in the counterclockwise direction of FIG. 12 (and the clockwise direction of FIG. 15), due to the tension of the cam gear bias spring 108. When the tip end of the extension piece 129 of the stopper 121 reaches and is engaged with the latch concave section 130*c*, the cam gear 102 stops rotating. As a result, as shown in FIGS. 13 and 16, the stopper 121 is kept at the protruded position, and the cam gear 102 remains not coupled to the roller shaft 31*a* of the developer roller 31. At this time, as shown in FIGS. 8 and 9 by the latch pin 119 of the developer electrode 95 being engaged with the return restriction section 133 of the stopper 121 by the biasing force of the electrode bias spring 117, the developer electrode 95 is kept at the connection position. In such a state, as shown in FIG. 13, when viewed from the side, the cam pin 118 of the developer electrode 95 is at a position overlaying the sloped section 105*c* of the press section 105 of the cam gear 102, and it is kept at a position above the sloped section 105*c* (i.e., with some space). As such, when the developer electrode 95 is kept at the connection position, as shown in FIG. 3, the contact point section 113 of the developer electrode 95 protrudes outside the cover member 97 and abuts the power supply electrode 115 in the body frame 2. With such abutment, the developer roller 31 is electrically connected to the bias application circuit 71 in the body frame 2 via the various components, e.g., including the conductor plate 99, the electrode bias spring 117, the developer electrode 95, and the power supply electrode 115 in this illustrated example. During a printing operation, the bias application circuit 71 applies a developer bias voltage to the developer roller 31.

When the process cartridge 17 is to be detached from the body frame 2 for maintenance purposes or exchange of the developer cartridge 28, with the detaching operation, the release protrusion 131 in the body frame 2 abuts and presses down the abutment protrusion 127 of the stopper 121 so that the engagement between the extension piece 129 of the stopper 121 and the latch concave section 130*c* of the cam gear 102 is released. In response thereto, due to the tension of the cam gear bias spring 108, the cam gear 102 rotates in the counterclockwise direction in the drawings, i.e., from the position of FIG. 13 to the initial position of FIG. 11 (from which the coupling operation is initiated, i.e., the tooth section 103 of the cam gear 102 is meshed with the developer roller gear 100). During this movement, the extension piece 129 of the stopper 121 abuts the stopper displacement section 130 and moves across the chord section 130*b* to reach the arc section 130*a* so that the stopper 121 is displaced to the no-protrusion position (see FIGS. 15 and 14). In response to the displacement of the stopper 121 to the no-protrusion position as such, the latch is released between the latch pin 119 of the developer electrode 95 and the return restriction section 133 of the stopper 121, and the developer electrode 95 is displaced to the retracted position by the biasing force of the electrode bias spring 117. As such, in the state where the developer cartridge 28 is detached from the body frame 2, the developer electrode 28 returns to the retract position, and the contact point section 113 of the developer electrode 95 is (at least partially) covered by the cover member 97.

6. Effects of this Example Structure

According to the example printer structure 1 described above, when the developer cartridge 28 is attached to the body frame 2, the developer electrode 95 is disposed at the connection position to connect with the power supply electrode 115 provided on the side of the body frame 2. When the developer cartridge 28 is not attached to the body frame 2, the developer electrode 95 is disposed at a sheltered position, retracted from the connection position (and located at least partially within the cover member 97, which forms a part of the developer cartridge housing). With such a configuration, when the developer cartridge 28 is individually carried around, the developer electrode 95 is retracted from the connection position and may be protected from damage possibly caused by contact or interference with other components.

Further, at the connection position, the developer electrode 95 protrudes outside of the cover member 97 as compared with its location at the retracted position. Using such structures, the developer electrode 95 does not protrude outside of the cover member 97 (and is not openly exposed) when the developer cartridge 28 is not attached to the device body 2. This feature, for example, enables a size reduction of the developer cartridge 28, and which makes the developer cartridge 28 easy to insert into and remove from the device body 2. Moreover, the developer electrode 95 can be protected from damage. Additionally, because the developer electrode 95 does not protrude outside, the developer cartridge 28 can be simply packaged and/or carried around.

The printer structure 1 according to this example of the invention ensures conductivity between the developer roller 31 and the developer electrode 95 even though the developer electrode 95 is displaced against the cabinet 79 of the developer cartridge 28. To ensure this conductivity according to the configuration of this example structure 1, the electrode bias spring 117 provided for biasing the developer electrode 95 establishes an electrical connection between the developer electrode 95 and the developer roller 31. Therefore, maintaining conductivity can be ensured with a simple configuration.

Still further, with this illustrated example structure 1, when the developer cartridge 28 is attached to the device body 2, the developer electrode 95 is displaced from the retract position to the connection position by the electrode displacement mechanism 96 in response to a driving force coming from the side of the device body 2 to the developer roller 31. As such, when the developer cartridge 28 is to be used, the developer electrode 95 located at the retract position can be automatically displaced to the connection position. This favorably eliminates the need to specifically provide means for displacing the developer electrode 95 to the side of the device body 2. What is more, because the developer electrode 95 does not protrude from the developer cartridge 28 before the developer cartridge 28 is completely attached, the attachment and detachment operations of the developer cartridge 28 can be smoothly executed.

Also, in this example structure 1, the driving force transmission section 85 that transmits a driving force from the side of the device body 2 to the developer roller 31 is disposed at an axial end portion of the developer roller 31 opposite to the location of the electrode displacement mechanism 96. Such a configuration favorably prevents the various components of the overall structure 1 from being densely packed on one side, and thus adequate space can be easily reserved for placement of the various components.

Still further, as the developer roller 31 rotates, the developer electrode 95 is pressed and displaced from the retract position side to the connection position side by the cam gear 102 that is coupled to the roller shaft 31*a* of the developer roller 31 to rotate together. As such, displacement of the developer electrode 95 can be easily accomplished using this example structure according to the invention.

The cam gear 102 of this illustrated example structure 1 is an intermittent gear, free from coupling with the roller shaft 31*a* of the developer roller 31 after the developer electrode 95 is pressed and displaced to the connection position. Power from the developer roller 31, therefore, is not transmitted to the developer electrode 95 at the time of printing or at other times so that the developer electrode 95 can remain at the connection position.

Additionally, in this example structure 1, as the developer cartridge 28 is detached from the device body 2, the electrode displacement mechanism 96 displaces the developer electrode 95 from the connection position to the retract position. More specifically, the release protrusion 131 provided with the body frame 2 abuts the stopper 121 that restricts the developer electrode 95 not to displace to the retract position so that the stopper 121 is displaced. With displacement of the stopper 121 as such, the restriction is released, and the developer electrode 95 is displaced to the retract position by the biasing force of the electrode bias spring 117. This action protects the developer electrode 95 from damage possibly caused by contact or interference with other components even when the developer cartridge 28 is detached and/or removed from the body frame 2 for maintenance or other purposes.

As the developer cartridge 28 is detached from the device body 2, the electrode displacement mechanism 96 puts the cam gear 102 (which is not coupled to the roller shaft 31*a* of the developer roller 31) into a coupled state. More specifically, the release protrusion 131 provided with the body frame 2 abuts the stopper 121 latching the cam gear 102 to the non-coupled state so that the latch is released. Due to the biasing force of the cam gear bias spring 108, the cam gear 102 is displaced to the initial position to be coupled to the roller shaft 31*a*. With such displacement, when the developer cartridge 28 is attached to the device body again, the cam gear 102 can displace the developer electrode 95 to the connection position again.

When the developer cartridge 28 is attached to the body frame 2, the developer electrode 95 is displaced to the connection position by electrode displacement means, which in this illustrated example structure 1 is configured by the main motor 66, the driving force transmission gear 87, the developer roller 31, the developer roller shaft gear 100, and the cam gear 102. Other structural arrangements, parts, and the like also may be included in an electrode displacement means without departing from this invention. After the displacement as such, the developer electrode 95 is connected to the power supply electrode 115 for bias application.

As the developer cartridge 28 is detached from the body frame 2, the developer electrode 95 is displaced from the connection position to the retract position by electrode retract means, which in this illustrated example structure 1 is configured by the release protrusion 131, the stopper 121, and the electrode bias spring 117. Other structural arrangements, parts, and the like also may be included in an electrode retract means without departing from this invention. This arrangement and action protects the developer electrode 95 from damage possibly caused by contact or interference with other components even when the developer cartridge 28 is detached for maintenance or other purposes.

B. SECOND EXAMPLE

Figure 17:
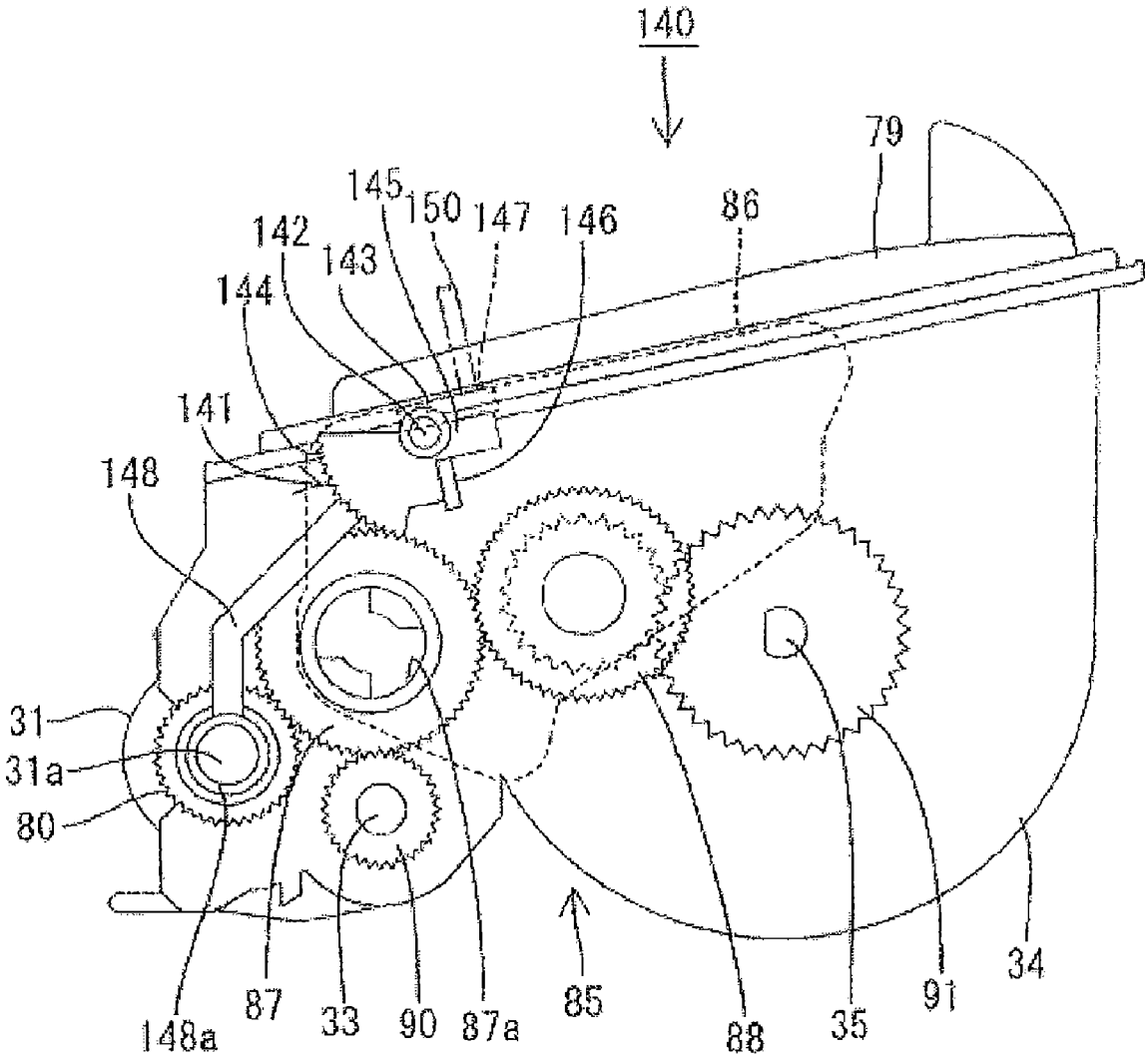
FIG. 17 is a side view of an example developer cartridge having an old/new condition indication member including one or more aspects or features of the present invention (with the old/new condition indication member in a retracted (or "new condition") position)
Figure 18:
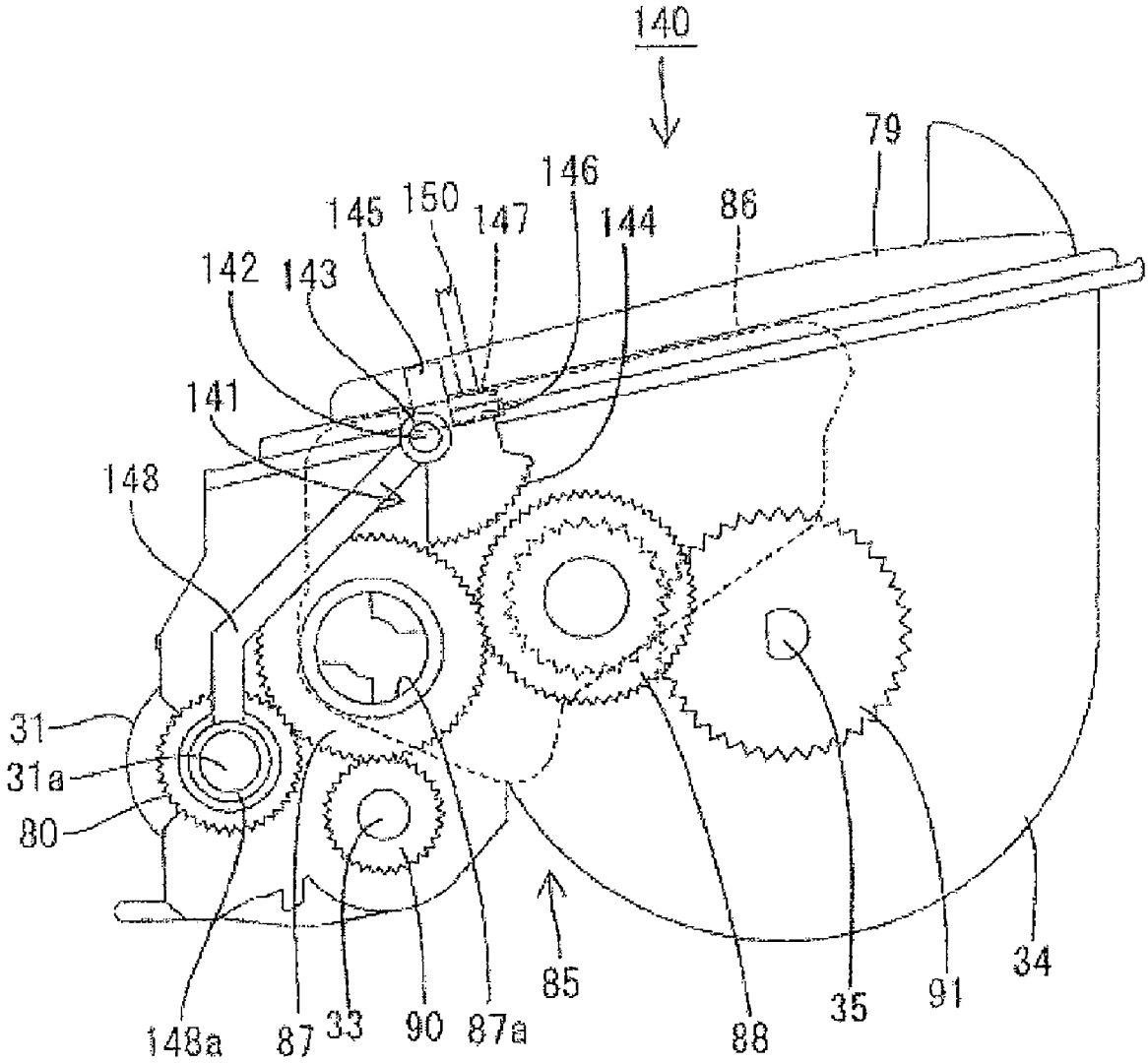
FIG. 18 is a side view of the example developer cartridge of FIG. 17 (with the old/new condition indication member in an extended (or "old condition") position).

Referring to FIGS. 17 and 18, another example of structures, features, and aspects of the present invention will be described. FIGS. 17 and 18 are both simplified side views of another developer cartridge 140 that includes features and aspects of this invention. In the following description, any structural component similar to that of the first example structure described above in conjunction with FIGS. 1-16 is provided with the same reference numeral, and these similar structural components are not described again.

The developer cartridge 140 includes a driving force transmission section 85 that transmits power from the main motor 66 to the developer roller 31 and other components. The driving force transmission section 85 is disposed on the left side surface of the cabinet 79. The driving force transmission section 85 of this example structure 140 includes a gear cover, and inside the gear cover 86, an old/new condition indication member 141 is provided above the driving force transmission gear 87 to indicate whether (and to enable a determination of whether) the developer cartridge 140 is in an old or new condition.

This old/new condition indication member 141 is constructed from a conductive synthetic resin. An indication member attachment shaft 142 (e.g., made of a conductive metal material) protrudes outward from a side surface of the cabinet 79. Portions of the old/new condition indication member 141 may be attached so as to be able to rotate about the indication member attachment shaft 142 by snapping a tube-shaped attachment tube 143 (included as part of the old/new condition indication member 141) to the indication member attachment shaft 142. The old/new condition indication member 141 of this example structure 140 includes a tooth section 144 that can be meshed with the driving force transmission gear 87. The old/new condition indication member 141 of this example also includes a detection protrusion 145 that protrudes against the indication member attachment shaft 142 to the side substantially opposite to the tooth section 144. The old/new condition indication member 141 of this example structure 140 also includes, as one piece, a developer electrode 146 that is adjacent to the detection protrusion 145 and extends outward, i.e., toward the front side of the drawing. The upper surface of the gear cover 86 is formed with an aperture section 147 at the position corresponding to the detection protrusion 145 and the developer electrode 146. If desired, the developer electrode 146 may be a separate part, e.g., engaged with the detection protrusion 145.

On the left side surface of the cabinet 79, an arm member 148 is attached to establish an electrical connection between the developer electrode 146 and the roller shaft 31*a* of the developer roller 31. This arm member 148 is formed like a narrow board made of conductive synthetic resin. The arm member 148 is shaped to include a tube-like connection tube section 148*a* at one end portion, and this tube section 148*a* is snapped to the rim of the roller shaft 31*a* of the developer roller 31. The other end portion of the arm member extends in the diameter direction of the roller shaft 31*a*. The end portion of the arm member 148 opposite to the roller shaft 31*a* is provided with a tube-like connection tube section (not shown) that may be snapped to the rim of the indication member attachment shaft 142. With such a configuration, the roller shaft 31*a* of the developer roller 31 is electrically connected to the developer electrode 146 via the arm member 148, the indication member attachment shaft 142, and the old/new condition indication member 141.

The old/new condition indication member 141 is allowed to displace between a "new-condition" position of FIG. 17 and an "old-condition" position of FIG. 18. When the old/new condition indication member 141 is located at the new-condition position, as shown in FIG. 17, the tooth section 144 meshes with the driving force transmission gear 87, and the detection protrusion 145 does not protrude outside of the gear cover 86. When the old/new condition indication member 141 is located at the old-condition position, as shown in FIG. 18, the tooth section 144 does not touch the driving force transmission gear 87, and the detection protrusion 145 protrudes from the aperture section 147 to the upper surface of the gear cover 86. When the old/new condition indication member 141 is located at the new-condition position, the developer electrode 146 is guided to the non-exposed, retract position, the electrode 146 being located behind the aperture section 147. When the old/new condition indication member 141 is located at the old-condition position, the developer electrode 146 is guided to the connection position and is exposed through the aperture section 147 to a location outside the gear cover 86. When the developer cartridge 140 is new, the old/new condition indication member 141 is kept at the new-condition position.

In the body frame 2, an actuator (not shown) engages the old/new condition determination sensor, and it constitutes a part of the above-described detection section 69. This actuator is disposed so as to be able to abut the detection protrusion 145 when it is at the old-condition position so that the position of the old/new condition indication member 141 thereby can be detected. Also in the body frame 2, a power supply electrode 150 connected to the bias application circuit 71 is provided to contact with the developer electrode 146 when the developer electrode 146 is located at the connection position.

In the control device 60, when the detection section 69 detects that the main power is turned on or the front cover 2*a* is closed, the old/new condition indication sensor detects the position of the old/new condition indication member 141. Thereafter, the input gear is coupled to the coupling section 87*a* of the driving force transmission gear 87 in the driving force transmission section 85, and the main motor 66 is driven. With the old/new condition indication member 141 located at the new-condition position, when the driving force transmission gear 87 is rotated by power from the main motor 66, the old/new condition indication member 141 responsively rotates in the counterclockwise direction in the drawing, and reaches the old-condition position at which the mesh is released between the tooth section 144 and the driving force transmission gear 87. Thereafter, the old/new condition indication member 141 does not rotate again to return to the new-condition position, i.e., it is irreversibly rotated from the new-condition position to the old-condition position. With displacement of the old/new condition indication member 141 to the old-condition position, the developer electrode 146 displaces from the retract position to the connection position, and it is exposed through the aperture section 147 and abuts the power supply electrode 150. As such, the developer roller 31 of this example structure is electrically connected to the bias application circuit 71 in the body frame 2 via the following components: the arm member 148, the indication member attachment shaft 142, the old/new condition indication member 141, the developer electrode 146, and the power supply electrode 150. During a printing operation, the bias application circuit 71 applies a developer bias voltage to the developer roller 31.

As described above, in the present example structure 140, the developer electrode 146 is provided, as an integral piece or part of the old/new condition indication member 141, which functions to indicate (and allow determination of) whether the developer cartridge 140 is in an old or new condition. These features and functions eliminate the need to provide any special structural component(s) to displace the developer electrode 146 so that the configuration can be favorably simplified.

When the developer cartridge 140 is used for the first time, the old/new condition indication member 141 is displaced from the new-condition position to the old-condition position by the driving force transmission gear 87 that receives a driving force coming from the side of the body frame 2 to the developer roller 31. This action enables the developer electrode 146 to be displaced from the retract position to the connection position.

What is more, the roller shaft 31*a* of the developer roller 31 and the developer electrode 146 are connected to each other via the conductive arm member 148 extending in the diameter direction of the roller shaft 31*a* so that the space can be increased between the developer electrode 146 and the developer roller 31. The larger space can reduce transmission of oscillations of the developer roller, when the developer roller 31 rotates, to the developer electrode 146. Accordingly, the contact state can be stabilized between the developer electrode 146 and the power supply electrode 150.

In this example structure 140, the developer electrode 146 is displaced to the connection position by an electrode displacement means, which is configured in this example structure to include: the main motor 66, the driving force transmission gear 87, and the old/new condition indication member 141. Of course, other structures, components, and/or arrangements of parts may be used in the electrode displacement means without departing from this invention. The developer electrode 146 is then connected to the power supply electrode 150 for bias application.

C. CONCLUSION

While the invention has been described in detail, the foregoing description and the structures shown in the accompanying drawings are in all aspects illustrative and not restrictive. For example, it is to be understood that the following variations and modifications are included within the scope of the invention:

1. In the above example structures, the system for displacing a developer electrode utilizes a driving force coming from a main motor to a developer roller. The developer electrode may be displaced by any other desired method, e.g., an image formation device body may be provided with electrode displacement means that displaces, separately from the developer roller, a developer electrode of a developer cartridge directly or indirectly. Alternatively, the electrode displacement means may displace a developer electrode utilizing the power of a motor or other source, or utilizing the attachment operation of the developer cartridge into the image formation device body.
2. In the above example structures, a developer cartridge including a developer roller is separately provided from an image carrier cartridge including an image carrier. Aspects and features of this invention also may be used in structures where a developer roller and an image carrier are provided in a single cartridge. As an additional alternative, aspects and features of this invention may be used when no image carrier cartridge is present and/or when a photosensitive belt arrangement is used.
3. In the above example structures, a power supply electrode is provided on the side of the image formation device body. Alternatively, if desired, the power supply electrode may be provided as part of the image carrier cartridge or as part of another portion of the overall structure.

A wide variety of other structural and/or functional modifications and variations may be provided without departing from the spirit and scope of the invention, as defined in the claims that follow.

What is claimed is:

1. A developer cartridge, comprising:

a cartridge housing;

a developer roller configured to output developer from the cartridge housing; and a developer electrode electrically connected to the developer roller, wherein the developer electrode is configured to be movable with respect to the cartridge housing between a connection position for connecting to a power supply electrode for bias application and a retract position different from the connection position, wherein the developer electrode in the connection position is farther away outward from the cartridge housing than in the retract position.

2. The developer cartridge according to claim 1, wherein at the connection position, the developer electrode extends outside of the cartridge housing.

3. The developer cartridge according to claim 1, further comprising:

a cover member configured to cover the developer electrode when at the retract position and configured to allow the developer electrode to be exposed when at the connection position.

4. The developer cartridge according to claim 1, further comprising:

a spring member configured to urge the developer electrode from the connection position to the retract position or from the retract position to the connection position, wherein the spring member provides at least a portion of an electrical connection between the developer electrode and the developer roller.

5. A developer cartridge, comprising:

a cartridge housing;

a developer roller that outputs developer from the cartridge housing;

a developer electrode electrically connected to the developer roller, wherein the developer electrode is movable with respect to the cartridge housing between a connection position for connecting to a power supply electrode for bias application and a retract position different from the connection position; and an electrode displacement mechanism configured to move the developer electrode from the retract position to the connection position in response to a driving force from an external source to the developer roller.

6. The developer cartridge according to claim 5, wherein a driving force transmission section is provided at a first axial end of the developer roller and is configured to transmit the driving force to the developer roller, and wherein the electrode displacement mechanism is provided at a second axial end of the developer roller.

7. The developer cartridge according to claim 5, wherein the electrode displacement mechanism includes a cam gear coupled to the developer roller and rotatable therewith, and wherein the electrode displacement mechanism further includes a press section configured to displace the developer electrode from the retract position to the connection position in response to rotation of the developer roller.

8. The developer cartridge according to claim 7, wherein the cam gear is an intermittent gear configured to disengage free from the developer roller after rotating to a position at which the developer electrode is located at the connection position.

9. The developer cartridge according to claim 8, wherein the electrode displacement mechanism is configured to move the developer electrode from the connection position to the retract position and couples the cam gear with the developer roller when the developer cartridge is detached from an image formation device mainbody.

10. The developer cartridge according to claim 5, wherein the electrode displacement mechanism is configured to move the developer electrode from the connection position to the retract position when the developer cartridge is detached from an image formation device mainbody.

11. The developer cartridge according to claim 1, further comprising:

an old/new condition indication member that indicates whether the developer cartridge is in an old or new condition, wherein the developer electrode is engaged or integrally formed with the old/new condition indication member such that when the developer electrode is moved from the retract position to the connection position, the old/new condition indication member changes from a new-condition position to an old-condition position.

12. The developer cartridge according to claim 11, further comprising:

an indication member displacement section configured to move the old/new condition indication member from the new-condition position to the old-condition position in response to a driving force from an external source to the developer roller.

13. The developer cartridge according to claim 11, further comprising:

an arm member having a first end portion electrically connected to the developer roller and a second end portion extending in a diameter direction of the developer roller and electrically connected to the developer electrode.

14. The developer cartridge according to claim 13, wherein the developer roller and the old/new condition indication member are separated by a space, and the arm member extends through the space.

15. A process cartridge, comprising:

a developer cartridge including:

a developer cartridge housing, a developer roller configured to supply developer to an image carrier, and a developer electrode electrically connected to the developer roller, wherein the developer electrode is configured to be movable with respect to the developer cartridge housing between a connection position as connected to a power supply electrode for bias application and a retract position; and an image carrier cartridge, wherein the developer cartridge is configured to be attachable to and detachable from the image carrier cartridge, and wherein the image carrier cartridge includes the image carrier that is configured to receive developer from the developer roller, wherein the developer electrode in the connection position is farther away outward from the cartridge housing than in the retract position.

16. An image formation device, comprising:

a mainbody;

a developer cartridge configured to be is attachable to and detachable from the mainbody, wherein the developer cartridge includes:

a cartridge housing;

a developer roller configured to supply developer from the cartridge housing to an image carrier, and a developer electrode electrically connected to the developer roller, wherein the developer electrode is configured to be movable with respect to the cartridge housing between a connection position as connected to a power supply electrode provided with the mainbody for bias application when the developer cartridge is attached to the mainbody, and a retract position retracted from the connection position when the developer cartridge is not attached to the mainbody;

a drive unit configured to apply a driving force to the developer roller; and a bias application unit electrically connected to the power supply electrode configured to apply a developer bias to the developer roller, wherein the developer electrode in the connection position is farther away outward from the cartridge housing than in the retract position.

* * * * *